US010159347B2

(12) United States Patent
Costaglia

(10) Patent No.: US 10,159,347 B2
(45) Date of Patent: Dec. 25, 2018

(54) TILT MECHANISM FOR A WEIGHT-RESPONSIVE SEATING FURNITURE

(71) Applicant: L&P PROPERTY MANAGEMENT COMPANY, South Gate, CA (US)

(72) Inventor: Massimo Costaglia, Santa Giustana in Colle (IT)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/517,116

(22) PCT Filed: Nov. 13, 2014

(86) PCT No.: PCT/EP2014/074463
§ 371 (c)(1),
(2) Date: Apr. 5, 2017

(87) PCT Pub. No.: WO2016/074723
PCT Pub. Date: May 19, 2016

(65) Prior Publication Data

US 2017/0295935 A1 Oct. 19, 2017

(30) Foreign Application Priority Data

Nov. 13, 2014 (WO) ..... PCT/EP2014/074463

(51) Int. Cl.
*A47C 1/032* (2006.01)
*A47C 7/02* (2006.01)

(52) U.S. Cl.
CPC ..... *A47C 1/03255* (2013.01); *A47C 7/02* (2013.01); *A47C 7/024* (2013.01); *A47C 1/032* (2013.01)

(58) Field of Classification Search
CPC ..... A47C 1/032; A47C 1/03255; A47C 7/02; A47C 7/024
USPC ..... 297/285, 296, 297
See application file for complete search history.

(56) References Cited

U.S. PATENT DOCUMENTS 4,533,177 A * 8/1985 Latone ..... A47C 3/026 297/285
4,585,272 A * 4/1986 Ballarini ..... A47C 3/12 297/285 X
4,685,730 A * 8/1987 Linguanotto ..... A47C 1/03216 297/316
4,744,603 A * 5/1988 Knoblock ..... A47C 1/03255 297/285

(Continued)

*Primary Examiner* — Rodney B White
(74) *Attorney, Agent, or Firm* — Shook Hardy & Bacon, LLP

(57) ABSTRACT

A chair back height adjustment mechanism comprises a guide having an abutment surface at a lateral side of the guide which extends along an adjustment direction. The chair back height adjustment mechanism comprises an adjusting device supported on the guide so as to be displaceable along the adjustment direction. The adjusting device comprises a carrier, a coupling member which is moveably supported on the carrier, and a bias mechanism. The coupling member has a contact face shaped to abut on the abutment surface of the guide and a slanted face. The bias mechanism is operative to apply a force onto the slanted face to urge the contact face of the coupling member against the abutment surface of the guide.

20 Claims, 16 Drawing Sheets

(56) References Cited

U.S. PATENT DOCUMENTS 4,765,679 A * 8/1988 Lanuzzi ..... A47C 1/03255 297/300.3
4,981,326 A * 1/1991 Heidmann ..... A47C 3/026 297/285
5,039,163 A * 8/1991 Tolleson ..... A47C 7/445 297/297
5,100,200 A * 3/1992 Keusch ..... A47C 1/03238 297/296
5,193,880 A * 3/1993 Keusch ..... A47C 1/03255 297/296
5,401,077 A * 3/1995 Hosoe ..... A47C 1/03 297/312
5,423,594 A * 6/1995 Hancock ..... A47C 1/0325 297/300.2
5,904,397 A * 5/1999 Fismen ..... A47C 7/024 297/296 X
6,406,096 B1 * 6/2002 Barile, Sr. ..... A47C 7/445 297/296
6,471,293 B2 * 10/2002 Ware ..... A47C 7/445 297/285 X
6,779,846 B2 * 8/2004 Spendlove ..... A47C 7/445 297/296
6,820,934 B2 * 11/2004 Ware ..... A47C 7/445 297/285 X
6,896,327 B1 * 5/2005 Barile, Sr. ..... A47C 7/445 297/285
7,118,177 B2 * 10/2006 Piretti ..... A47C 7/44 297/296
8,272,693 B2 * 9/2012 Hall ..... A47C 1/03272 297/296
8,388,064 B2 * 3/2013 Bertolini ..... A47C 7/445 297/285
8,567,864 B2 * 10/2013 Deisig ..... A47C 3/045 297/285
8,820,835 B2 * 9/2014 Minino ..... A47C 7/44 297/285
9,004,596 B2 * 4/2015 Barile, Jr. ..... A47C 7/445 297/297 X
9,572,432 B2 * 2/2017 Deisig ..... A47C 3/045
9,833,074 B2 * 12/2017 Bohmann ..... A47C 1/032
2002/0171276 A1 * 11/2002 Bock ..... A47C 1/03255 297/300.1
2008/0217977 A1 * 9/2008 Aldrich ..... A47C 1/023 297/285 X
2010/0259082 A1 * 10/2010 Votteler ..... A47C 1/03255 297/285

* cited by examiner

TILT MECHANISM FOR A WEIGHT-RESPONSIVE SEATING FURNITURE

CROSS-REFERENCE TO RELATED APPLICATIONS

This application claims priority under 35 U.S.C. § 365 to PCT/EP2014/074463, filed on Nov. 13, 2014, entitled "Tilt Mechanism for a Weight-Responsive Seating Furniture," the entirety of which is incorporated by reference herein.

FIELD OF THE INVENTION

Embodiments of the invention relate to a tilt mechanism for seating furniture. Embodiments of the invention relate in particular to a tilt mechanism for a chair or another seating furniture which is weight-responsive, and to a seating furniture which includes such a mechanism.

BACKGROUND OF THE INVENTION

For a wide variety of applications, chairs and other types of seating furniture are nowadays provided with features which provide enhanced comfort to the person using the chair. For illustration, office-type chairs are commonly utilized in modern working environments to provide an occupant with a level of comfort while performing certain tasks that require a person to be in a seated position for an extended period of time. Similar features may be provided in other types of chairs to provide enhanced comfort to the person sitting on the chair.

One common configuration for such a chair includes a chair base assembly and a superstructure. The superstructure may include components which enable the user to recline or "tilt" the backrest of the chair. This basic chair configuration allows users to change their sitting position in the chair as desired, such that fatigue may be minimized during long sitting periods.

In recent years, chair designs have implemented a feature where the recline characteristic of a chair backrest may be altered. For illustration, the force applied by the chair backrest during a recline motion may be varied, so as to better accommodate the needs of different users. Adjusting elements may be provided on the chair which allow a user to manually adjust the force applied by the chair backrest. Alternatively or additionally, weight-responsive chairs may be provided with a mechanism in which the force applied by the chair backrest during a recline motion depends on a weight of a person sitting on a seat of the chair.

Such tilt mechanisms for weight-responsive seating furniture offer constructive simplicity and lend themselves to a cost-efficient production. However, despite these qualities conventional tilt mechanisms for weight responsive seating furniture may suffer from shortcomings. Such shortcomings may include one or several of knee rise, heel rise and/or shear effect and back compression. In the art, knee rise refers to the movement of the front end of the seat along an upward arc when the back is reclined. This movement causes the user's knees and thighs to rise. In the art, heel rise refers to the effect that the user's heels loose contact with ground as a result of the upward movement of the front of the seat. In the art, shear effect and back compression refer to the effect that, while reclining the backrest, the seat rises upward because of its connection to the back support and the user's back slips against the backrest of the chair while being raised. This last issue also causes a compression of the user's back, still because of the seat's rear portion being raised. There is a continued need in the art for weight-responsive tilt mechanisms which mitigate one or several of knee rise, heel rise and/or shear effect and back compression.

BRIEF SUMMARY OF THE INVENTION

There is a continued need in the art for a tilt mechanism and a seating furniture which address some of the above needs. There is in particular a continued need in the art for a tilt mechanism which reduces at least one of knee rise, heel rise and/or shear effect and back compression effects, which are associated with the seat rise in conventional weight-responsive tilt mechanisms.

According to exemplary embodiments, a tilt mechanism for a weight-responsive seating furniture includes a segmented member. The segmented member includes a first segment which is coupled to move with a seat support and a second segment. The second segment is coupled to the first segment via an articulated connection.

The tilt mechanism may be configured such that when the seat support is raised by a reclining movement of a backrest support, the second segment is pivoted relative to the first segment. The upward movement of the front and/or rearward end of a seat may thereby be reduced. The shortcomings associated with at least one of knee rise, heel rise and/or shear effect and back compression effects may be mitigated.

The segmented member may have a lower face which overlays the seat support and an upper face on which upholstery of a seat may be supported.

A tilt mechanism for a weight-responsive seating furniture according to an embodiment comprises a base support, a backrest support, and a seat support. The seat support is coupled to the backrest support such that the seat support is displaced relative to the base support when the backrest support is pivoted. The tilt mechanism comprises a segmented member. The segmented member comprises a first segment which is attached to the seat support or which is integrally formed with the seat support. The segmented member comprises a second segment which is articulated to the first segment. The tilt mechanism comprises a linkage coupled to the second segment to pivot the second segment relative to the first segment when the seat support is displaced relative to the base support.

The segmented member may be arranged so as to overlay the seat support.

The segmented member may be configured to form a support surface which extends across a seat support at an upper end of the seat support.

The segmented member may be configured to form a support surface. The support surface may be configured to support the weight of a user's thighs and hips. The support surface may be arranged such that it extends above and along a ground plane on which the seating furniture is positioned.

The linkage may be configured to pivot the second segment downward relative to the first segment when the first segment is displaced upward by the seat support.

The linkage may be configured to pivot the second segment upward relative to the first segment when the first segment is displaced downward by the seat support.

The linkage may be pivotably coupled to the second segment.

The linkage may be pivotably coupled to at least one of the base support and the backrest support. The linkage may be slidably coupled to at least one of the base support and the backrest support.

The second segment may be attached to a front end of the first segment. The tilt mechanism may thus be configured to mitigate knee rise and/or heel rise effects.

The second segment may be attached to a rear end of the first segment. The tilt mechanism may thus be configured to mitigate shear effect and back compression effects.

The segmented member may further comprise a third segment articulated to the first segment. The third segment and the second segment may be provided on opposite sides of the first segment. The tilt mechanism may thus be configured to mitigate knee rise, heel rise, shear effect and back compression effects.

The tilt mechanism may comprise a further linkage coupled to the third segment to pivot the third segment relative to the first segment when the seat support is displaced relative to the base support.

The segmented member may be a seat of the weight-responsive seating furniture.

The segmented member may be sandwiched between the seat support and a seat of the seating furniture. The tilt mechanism may comprise a seat coupled to the segmented member such that the segmented member is sandwiched between the seat support and the seat.

The seat may have an adjustable depth. According to conventional terminology in this field of the art, an adjustable depth means that the seat position may be adjusted along the forward-rearward direction of the seat.

The seat may comprise a first seat section, a second seat section and an articulated connection between the first seat section and the second section.

The seat may be configured such that the articulated connection of the seat overlaps a position at which the second segment of the segmented member is articulated to the first segment of the segmented member.

The articulated connection of the seat may have a length, measured in the forward-rearward direction of the tilt mechanism, which is greater than a distance by which the depth of the seat may be adjusted.

The seat support may comprise a first lever. The tilt mechanism may comprise a second lever pivotably attached to the backrest support and coupled to the first lever to pivot the first lever when the backrest support pivots. The linkage may comprise a first link coupled to the second segment and a second link coupled to the first link and the first lever.

The first lever or the first link may comprise a slot in which a projection of the other one of the first lever or the first link is slidably received.

The first lever and the second lever may be received within a carrier. The carrier may have a U-shaped cross-section.

The second lever may be pivotably coupled to the first lever. The tilt mechanism may comprise an energy storage mechanism which biases at least one of the second lever and the backrest support.

According to an embodiment, a seating furniture is provided. The seating furniture may include a tilt mechanism according to any embodiment.

The seating furniture may have a seat which is attached to the segmented member of the tilt mechanism and a backrest which is attached to the backrest support.

The seating furniture may have a base to which the base support of the tilt mechanism is attached. The base may, but does not need to include a central support column.

Various effects may be attained by the tilt mechanisms and seating furniture of embodiments. The tilt mechanism is operative to reduce an upward travel of a front end and/or a rear end of a seat when the seat is raised during backrest recline. One or several of the shortcomings associated with conventional weight-responsive tilt mechanisms may thereby be mitigated.

The tilt mechanism and seating furniture according to embodiments may be utilized for various applications in which it is desired that the backrest applies a force during recline which depends on the weight of the person sitting on the seat. For illustration, the tilt mechanism may be installed in office chairs, community seating, chairs for the hospital sector, seats for the house, domestic furniture, seating on airports and in general waiting rooms, other public seating, seating for collaborative areas, without being limited thereto.

BRIEF DESCRIPTION OF DRAWINGS

Embodiments of the invention will be described with reference to the accompanying drawings in which like reference numerals designate like elements.

DETAILED DESCRIPTION OF EMBODIMENTS

Figure 1:
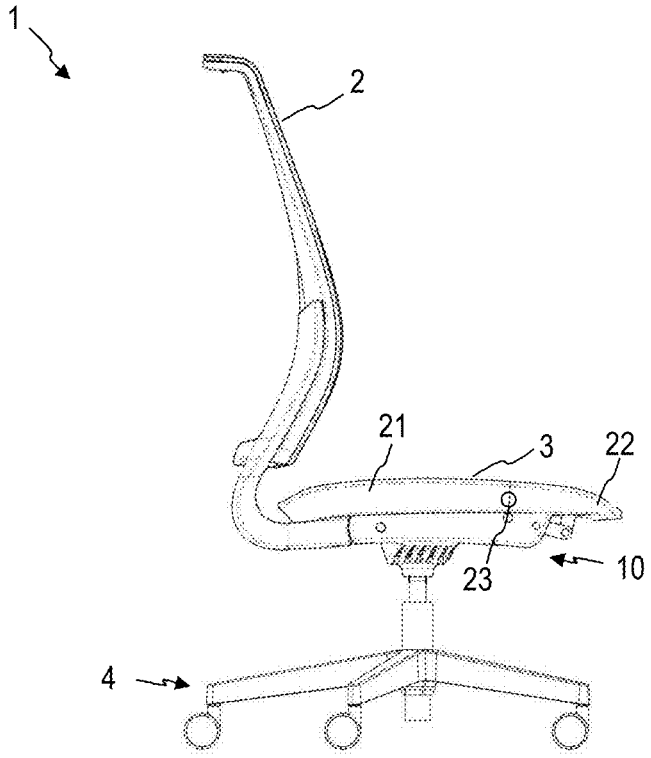
FIG. 1 is a perspective view of a chair having a tilt mechanism according to an embodiment.

Exemplary embodiments of the invention will be described with reference to the drawings. While some embodiments will be described in the context of specific fields of application, such as in the context of an office-type chair or a chair having four legs, the embodiments are not limited to this field of application. The features of the various embodiments may be combined with each other unless specifically stated otherwise.

It should be understood that the terms "forward", "front", "rearward", "rear", "lateral", "left" and "right" as used herein, each have a particular meaning that is defined in relation to a flat support surface beneath the chair and in relation to an occupant of the chair. For instance, the term "forward" refers to a direction moving away from the chair backrest and in front of a chair occupant along an axis which extends parallel to such a flat support surface, while the term "rearward" refers to a direction opposite of the forward direction. The term "lateral" refers to a generally horizontal direction perpendicular to both the forward and rearward direction and extending parallel to the aforementioned flat support surface.

According to embodiments, a tilt mechanism is provided which offers weight-responsive recline characteristics. The tilt mechanism is configured such that a seat support is raised when a backrest is reclined, and that a torque which depends on a weight force acting on the seat support is applied to a backrest support.

In order to mitigate shortcomings of conventional mechanisms which are associated with conventional weight-responsive mechanisms, the tilt mechanism includes a segmented member. The segmented member comprises a first segment and a second segment articulated to the first segment.

The second segment may be articulated to the first segment such that it is pivotable relative to the first segment about an axis which is parallel to a flat support surface on which a base of the seating furniture rests. The segmented member may have a lower face disposed towards the base support which overlays the base support. The segmented member may be comprised by the seat of the seating furniture or may be an intermediate member arranged between the seat support and the seat.

The tilt mechanism includes a linkage which selectively pivots the second segment relative to the first segment when the seat is raised due to a recline motion of the backrest support. The linkage may be configured to limit upward travel of the second segment by pivoting the second segment downward relative to the first segment of the segmented member. Upward travel of the front end and/or rear end of a seat may be reduced by this pivoting motion. One or several of knee rise, heel rise and/or shear effect and back compression effects may be mitigated.

The tilt mechanism of embodiments may comprise a base support of the seating furniture, e.g. a chair base support, or a carrier which, in use, may be fixedly attached to a base assembly of the seating furniture. The tilt mechanism further comprises a backrest support. A backrest may be attached to the backrest support. The tilt mechanism further comprises a seat support coupled to the backrest support such that the seat support is displaced relative to the base support when the backrest support is reclined. The tilt mechanism further comprises the segmented member comprising the first segment and the second segment. The first segment may be attached to the seat support or may be integrally formed with the seat support. The second segment is articulated to the first segment. The tilt mechanism comprises a linkage coupled to the second segment to pivot the second segment relative to the first segment when the seat support is displaced relative to the base support.

FIG. 1 shows a chair 1 according to an embodiment. While a chair is shown in FIG. 1, the tilt mechanism according to embodiments may be used in a wide variety of different seating furniture, including office chairs, community seating, chairs for the hospital sector, seats for the house, domestic furniture, seating on airports and in general waiting rooms, other public seating, seating for collaborative areas, without being limited thereto.

The chair 1 has a backrest 2, a seat 3, and a base assembly 4. The base assembly 4 supports the chair 1 on a floor. The chair 1 may be an office-type chair in which the base assembly 4 has a central column 5 on which the superstructure of the chair 1 rests.

The chair 1 has a tilt mechanism 10. The tilt mechanism 10 is configured to raise a seat support when the backrest 2 is reclined. A segmented member is overlaid on the base support and includes a first segment 21 and a second segment 22 articulated to the first segment. For illustration, the seat 3 may include a first segment 21 and a second segment which are pivotably coupled at a hinge connection or other articulated joint 23.

The tilt mechanism 10 comprises a linkage which is configured such that it pivots the second segment 22 downward relative to the first segment 21 when a seat support moves the first support upward.

Configurations of the tilt mechanism 10 according to various embodiments will be described in more detail with reference to FIG. 2 to FIG. 30.

Figure 2:
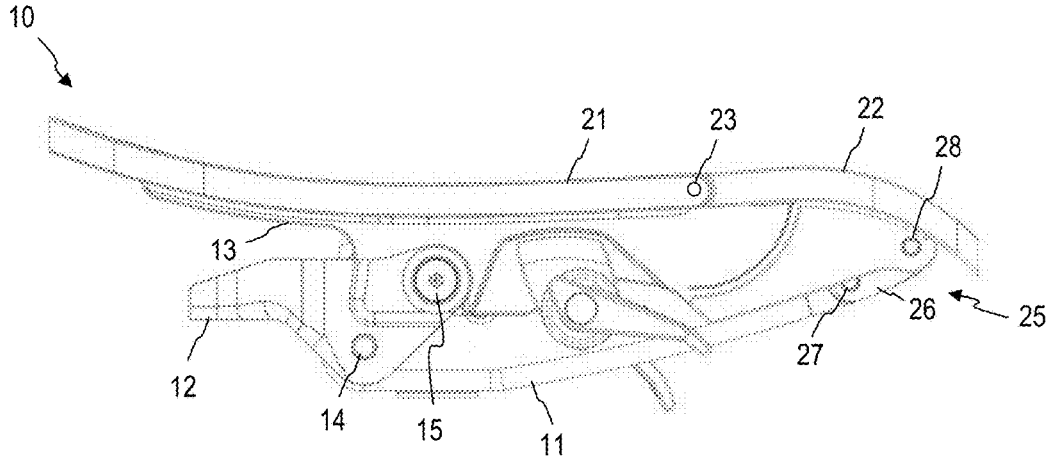
FIG. 2 is a side view of a tilt mechanism according to an embodiment.
Figure 3:
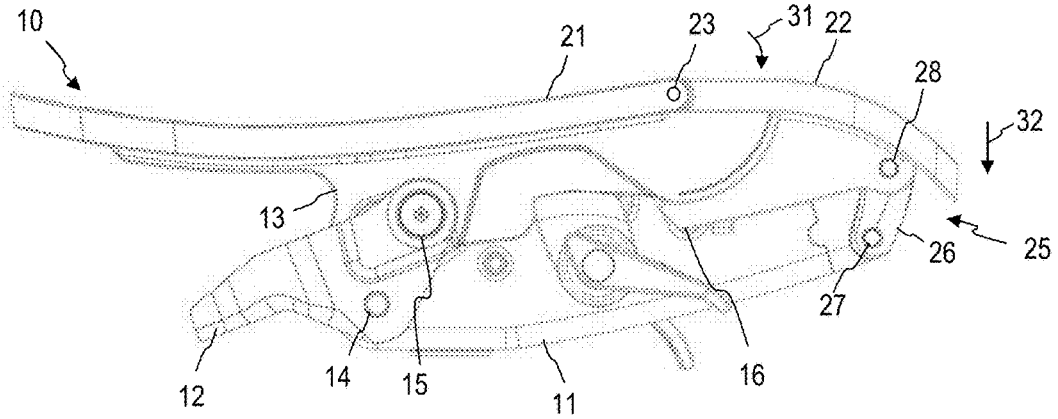
FIG. 3 is a side view of the tilt mechanism of FIG. 2 when the backrest support is reclined.

FIG. 2 and FIG. 3 are side views of a tilt mechanism 10 according to an embodiment. The tilt mechanism 10 may be installed in the chair 1 of FIG. 1 or in another seating furniture. FIG. 2 shows the tilt mechanism 10 when the backrest is not reclined and a backrest support is in a position which corresponds to the frontmost backrest position. FIG. 3 shows the tilt mechanism 10 when the backrest support is in a reclined state which corresponds to a reclined backrest.

The tilt mechanism 10 of FIG. 2 and FIG. 3 is operative to mitigate heel rise and knee rise effects.

The tilt mechanism 10 comprises a base support 11. The base support 10 may be configured as any carrier which is configured to be coupled to a chair base or other support structure. The tilt mechanism 10 comprises a backrest support 12 configured for attachment of the backrest 3. The backrest support 12 may be pivotably supported on the base support 11 or another component, e.g. the seat support. In the illustrated implementation, the backrest support 12 may be pivotably coupled to the base support 11 at a pivot 14.

The tilt mechanism 10 comprises a seat support 13. The seat support 13 may be displaceably mounted to the base support 11. The seat support 13 may be coupled to the backrest support 12 via a connection 15. The connection 15 may force the seat support 13 to raise when the backrest support 12 is reclined, thereby exerting a torque onto the backrest support 12 which depends on the downward force applied to the seat by the occupant. The connection 15 may have any one of a variety of configurations. For illustration, a guide pin provided on one of the backrest support 12 and the seat support 13 may be slidably received in a guide recess provided on the other one of the backrest support 12 and the seat support 13.

The tilt mechanism 10 comprises a segmented member. The segmented member comprises a first segment 21 and a second segment 22. The first segment 21 and the second segment 22 may be joined to each other so as to form a support surface. Upholstery or another seat component may be supported on an upper face of the segmented member. A lower face of the segmented member may face the base support 11. The segmented member may generally be overlaid on the base support 11 and, optionally, also on the seat support 13 and/or the backrest support 12.

In the tilt mechanism 20 of FIG. 2 and FIG. 3, the second segment 22 is provided on a front end of the first segment 21. As will be explained in more detail below, the second segment may also be provided at a rear end of the first segment.

The first segment 21 may be attached to the seat support 13 or may be integrally formed with the seat support 13, such that the first segment 21 moves jointly with the seat support. The first segment 21 may be rigidly attached to the seat support 13. When the seat support 13 is raised by a recline motion of the backrest support 12, the first segment 21 is forced to move jointly with the seat support 13.

The tilt mechanism 10 comprises a linkage 25. The linkage 25 is configured to limit an upward movement of a front end of the second segment 22 of the segmented member by pivoting the second segment 22 relative to the first segment 21 when the seat support 13 is displaced relative to the base support 11. The linkage 25 may interconnect the second segment 22 and the base support 11 or the backrest bracket 12, for example. The linkage 25 may include at least one link 26. The at least one link 26 may be pivotably attached to the base support 11 via a first pivot axis 27 and may be pivotably attached to the second segment 22 via a second pivot axis 28. Other configurations may be used. For illustration, the linkage 25 may include a plurality of links which are attached to each other. The link(s) may be coupled to the second segment 22 and/or the base support 11 in a manner which allows both a translatory displacement and a rotation of the link(s) relative to the base support 11 and/or the second segment 22.

Operation of the tilt mechanism 10 will be explained in more detail with reference to FIG. 3.

When the backrest 3 is reclined, the backrest support 12 pivots relative to the base support 11 on pivot 14. The recline motion of the backrest support 12 forces the seat support 13, via the connection 15, to travel upward. The link 26 is pivoted relative to the base support 11, but exerts a downward force onto the second segment 22 when the seat support 13 has travelled upward. The downward force causes the second segment 22 to pivot relative to the first segment 21. The second segment 22 may perform a downward pivoting motion 31 about the articulated connection 23. This leads to a downward motion 32 of the front end of the second segment 22 relative to the first segment. While the front end of the second segment 22 may still be raised relative to the base support 11 when the backrest is reclined, the downward movement 32 at least partially compensated the upward movement of the seat support 13. In some implementations, the linkage 25 may be configured such that the front end of the second segment 22 has substantially the same vertical position above ground when the backrest is fully reclined and when the backrest is not reclined. In other implementations, the linkage 25 may be configured such that the front end of the second segment 22 moves upward by a distance when the backrest is reclined which is less than the distance by which the seat support 13 is moved upward.

When the backrest is tilted forward and the backrest support 12 moves from the reclined position to the rest position, the linkage 25 may pivot the second segment 22 upward relative to the first segment 21, thereby returning the segmented member to the state shown in FIG. 2.

A tilt mechanism as explained with reference to FIG. 2 and FIG. 3 is configured to mitigate heel rise and knee rise effects. This is achieved by a seat divided in two parts. The rear first segment 21 may be connected directly to the mechanism's seat support 13. The frontal second segment 22 is pivotally connected to a pivot 23 located in the first segment 21 of the seat. The second segment 22 is connected to the base support 11 by a linkage 25 which includes a link 26 which is fitted to a pin 27 fixed to the base support and another pin 28 fixed to a front edge of the second segment 22.

When the backrest is reclined, the rear second segment 22 of the seat rises together with the seat support 13, while the frontal first segment 21 connected to the base support 11 is forced by the link 26 to pivot on pivot 23 such that the front end of the second segment 22 is pulled down relative to the rear first segment 21. This may reduce knee and heel rise.

Figure 4:
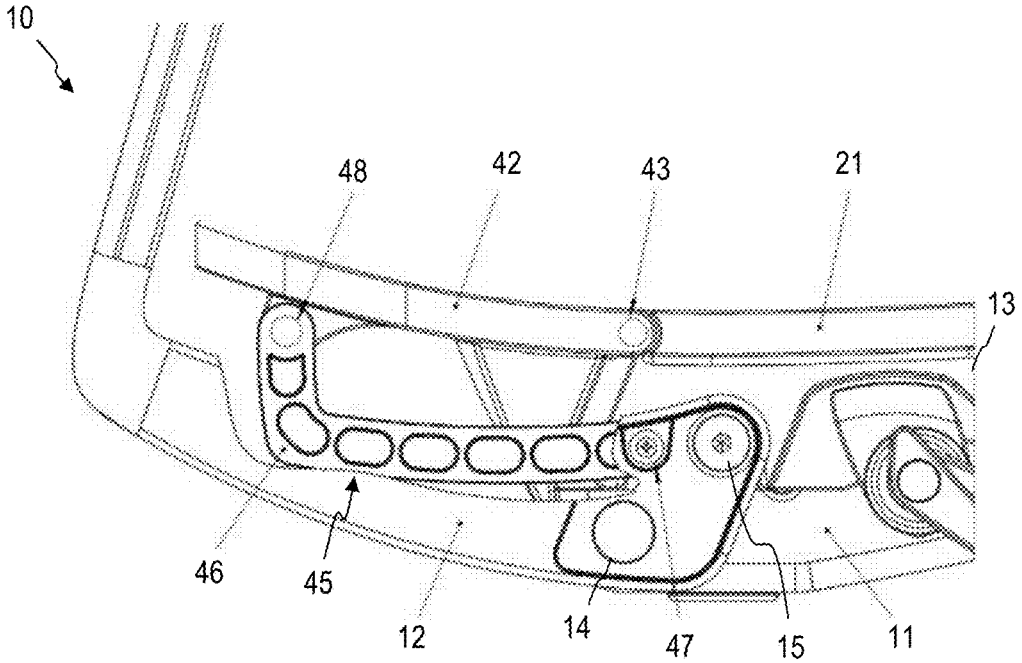
FIG. 4 is a side view of a tilt mechanism according to an embodiment.
Figure 5:
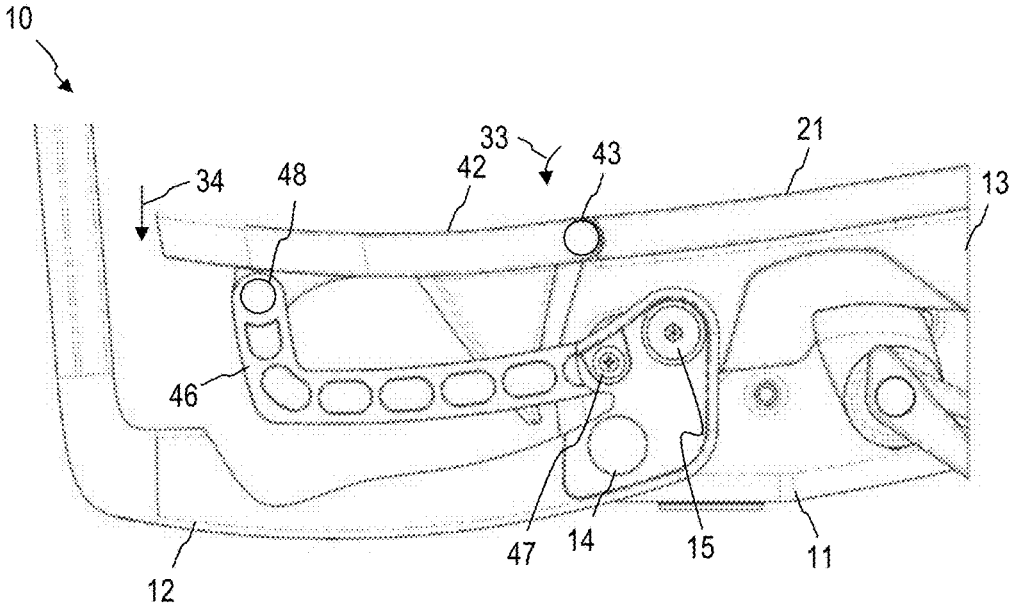
FIG. 5 is a side view of the tilt mechanism of FIG. 4 when the backrest support is reclined.

FIG. 4 and FIG. 5 are side views of a tilt mechanism 10 according to an embodiment. The tilt mechanism 10 may be installed in the chair 1 of FIG. 1 or in another seating furniture. FIG. 4 shows the tilt mechanism 10 when the backrest is not reclined and a backrest support is in a position which corresponds to the frontmost backrest position. FIG. 5 shows the tilt mechanism 10 when the backrest support is in a reclined state which corresponds to a reclined backrest.

The tilt mechanism 10 of FIG. 4 and FIG. 5 is operative to mitigate shear effect and back compression.

The tilt mechanism 10 comprises a base support 11, a backrest support 12 and a seat support 13. The base support, backrest support 12, and seat support 13 may be configured as explained with reference to FIG. 2 and FIG. 3, for example. The backrest support 12 is coupled to the seat support 13 such that a recline movement of the backrest support 12 causes the seat support 13 to be raised.

The tilt mechanism 10 comprises a segmented member. The segmented member comprises a first segment 21 and a second segment 42. The first segment 21 and the second segment 42 may be joined to each other so as to form a support surface. Upholstery or another seat component may be supported on an upper face of the segmented member. A lower face of the segmented member may face the base support 11. The segmented member may generally be overlaid on the base support 11 and, optionally, also on the seat support 13 and/or the backrest support 12.

In the tilt mechanism 20 of FIG. 4 and FIG. 5, the second segment 42 is provided on a rear end of the first segment 21.

The first segment 21 may be attached to the seat support 13 or may be integrally formed with the seat support 13, such that the first segment 21 moves jointly with the seat support. The first segment 21 may be rigidly attached to the seat support 13.

When the seat support 13 is raised by a recline motion of the backrest support 12, the first segment 21 is forced to move jointly with the seat support 13.

The tilt mechanism 10 comprises a linkage 45. The linkage 45 is configured to limit an upward movement of a rear end of the second segment 42 of the segmented member by pivoting the second segment 42 relative to the first segment 21 when the seat support 13 is displaced relative to the base support 11. The linkage 45 may interconnect the second segment 42 and the backrest bracket 12, for example. The linkage may also be connected between the second segment 42 and the base support 11. The linkage 45 may include at least one link 46. The at least one link 46 may be pivotably attached to the backrest support 12 via a first pivot axis 47 and may be pivotably attached to the second segment 42 via a second pivot axis 48. Other configurations may be used. For illustration, the linkage 45 may include a plurality of links which are attached to each other. The link(s) may be coupled to the second segment 42 and/or the backrest support 12 in a manner which allows both a translatory displacement and a rotation of the link(s) relative to the backrest support 12 and/or the second segment 42.

Operation of the tilt mechanism 10 will be explained in more detail with reference to FIG. 5.

When the backrest 2 is reclined, the backrest support 12 pivots relative to the base support 11 on pivot 14. The recline motion of the backrest support 12 forces the seat support 13, via the connection 15, to travel upward. The link 46 is pivoted relative to the base support 11, but exerts a downward force onto the second segment 42 when the seat support 13 has travelled upward. The downward force causes the second segment 42 to pivot relative to the first segment 21. The second segment 42 may perform a downward pivoting motion 33 about the articulated connection 43. This leads to a downward motion 34 of the rear end of the second segment 42 relative to the first segment 21. While the rear end of the second segment 42 may still be raised relative to the base support 11 when the backrest is reclined, the downward movement 34 at least partially compensated the upward movement of the seat support 13. In some implementations, the linkage 45 may be configured such that the rear end of the second segment 42 has substantially the same vertical position above ground when the backrest is fully reclined and when the backrest is not reclined. In other implementations, the linkage 45 may be configured such that the rear end of the second segment 42 moves upward by a distance when the backrest is reclined which is less than the distance by which the seat support 13 is moved upward.

When the backrest is tilted forward and the backrest support 12 moves from the reclined position to the rest position, the linkage 45 may pivot the second segment 42 upward relative to the first segment 21, thereby returning the segmented member to the state shown in FIG. 4.

A tilt mechanism configured as explained with reference to FIG. 4 and FIG. 5 is operative to reduce shear effect and back compression by reducing the upward movement of the rear edge of the seat during a backrest recline. This may be achieved by a seat divided in two parts. The frontal first segment 21 may be connected directly to the seat support 13. The rear second segment 42 is pivotally connected to a pivot 43 located in the first segment 21 of the seat. The rear second segment 42 is connected to the backrest support 12 via a link 46 which is fitted to a pin 47 fixed to the backrest support 12 and another pin 48 fixed to the rear edge of the second segment 42.

When the backrest is reclined, the rear second segment 42 is forced by link 46, connected to the backrest support 12, to pivot on pivot 47, which causes a downward movement 34 of the rear end of the second segment 42 and reduces back compression and shear effect.

Figure 6:
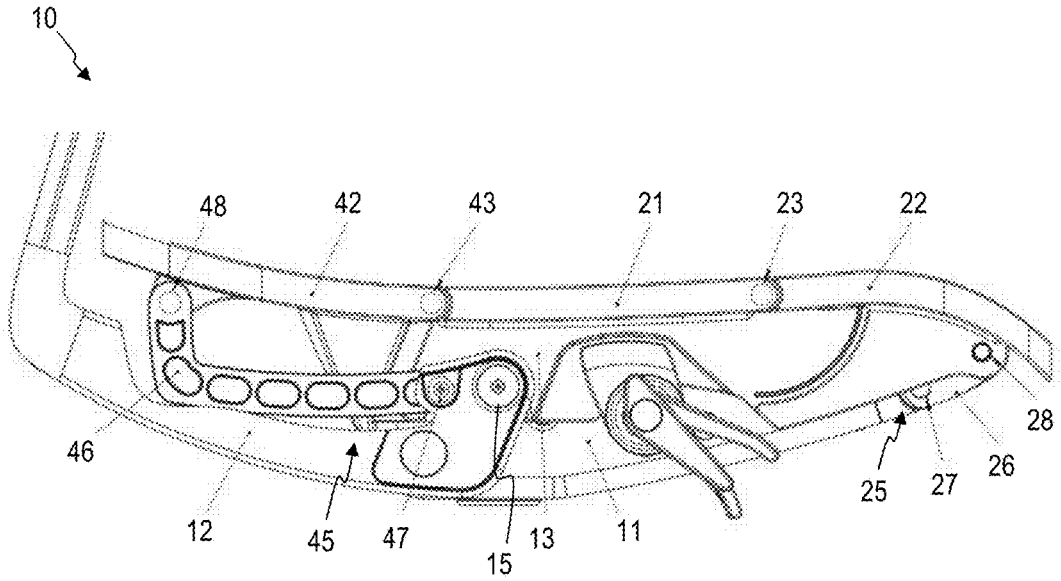
FIG. 6 is a side view of a tilt mechanism according to an embodiment.
Figure 7:
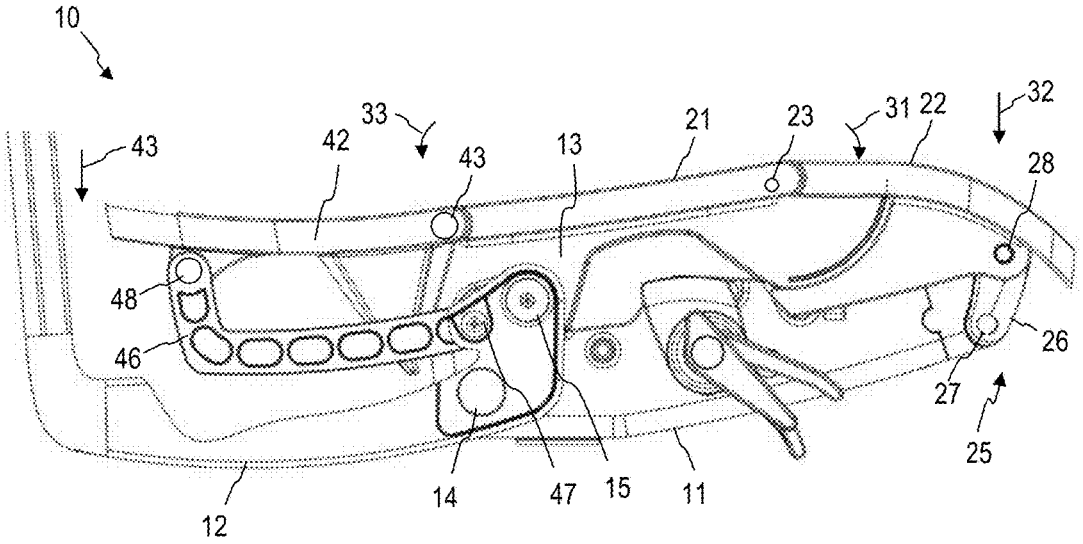
FIG. 7 is a side view of the tilt mechanism of FIG. 6 when the backrest support is reclined.

FIG. 6 and FIG. 7 are side views of a tilt mechanism 10 according to an embodiment. The tilt mechanism 10 may be installed in the chair 1 of FIG. 1 or in another seating furniture. FIG. 6 shows the tilt mechanism 10 when the backrest is not reclined and a backrest support is in a position which corresponds to the frontmost backrest position. FIG. 7 shows the tilt mechanism 10 when the backrest support is in a reclined state which corresponds to a reclined backrest.

The tilt mechanism 10 of FIG. 6 and FIG. 7 is operative to mitigate, heel rise and knee rise and shear effect and back compression effects.

The tilt mechanism 10 includes a base support 11, a backrest support 12, and a seat support which may be configured as explained with reference to FIG. 2 and FIG. 3, for example.

The tilt mechanism 10 includes a segmented member which comprises a first segment 21, a second segment 22 articulated to a front end of the first segment 21, and a third segment 42 articulated to a rear end of the first segment.

The first segment 21, the second segment 42 and the third segment may be joined to each other so as to form a support surface. Upholstery or another seat component may be supported on an upper face of the segmented member. A lower face of the segmented member may face the base support 11. The segmented member may generally be overlaid on the base support 11 and, optionally, also on the seat support 13 and/or the backrest support 12.

The first segment 21 may be attached to the seat support 13 or may be integrally formed with the seat support 13, such that the first segment 21 moves jointly with the seat support. When the seat support 13 is raised by a recline motion of the backrest support 12, the first segment 21 is forced to move jointly with the seat support 13.

The tilt mechanism 10 comprises a linkage 25 which is interconnected between the second segment 22 and the base support 11. The linkage 25 may be configured to pivot the second segment 22 relative to the first segment 21 when the seat support 13 is raised relative to the base support 11, thereby reducing upward travel of the front end of the second segment 22. The linkage 25 may be configured as explained with reference to FIG. 2 and FIG. 3. The tilt mechanism 10 comprises a further linkage 45. The further linkage 45 may be interconnected between the third segment 42 and one of the base support 11 and the backrest support 12. The further linkage 45 may be configured to pivot the third segment 42 relative to the first segment 21 when the seat support 13 is raised relative to the base support 11, thereby reducing upward travel of the rear end of the third segment 42. The further linkage 45 may be configured as explained with reference to FIG. 4 and FIG. 5.

Operation of the tilt mechanism will be explained further with reference to FIG. 7. When the backrest is reclined and the seat support is raised thereby, the linkage 25 causes the second segment 22 to pivot about the articulated connection 23. This pulls the front end of the second segment 22 downward relative to the first segment. When the backrest is reclined and the seat support is raised thereby, the further linkage 45 causes the third segment 42 to pivot about the articulated connection 43. This pulls the rear end of the third segment 42 downward relative to the first segment.

In the tilt mechanism of FIG. 6 and FIG. 7, both the front end and the rear end of the seat may be displaced relative to the first segment 21, thereby preventing excessive upward movement of the front end and the rear end of the seat.

A tilt mechanism which mitigates both knee and heel rise and shear effect and back compression may combine the principles explained with reference to FIG. 2 to FIG. 5. A seat may be divided in three parts. A central first segment 21 may be directly connected to the seat support 13. The central first segment 21 may define two pivots 23, 43 at its opposing ends. The rear third segment 42 may be pivotally connected to the pivot 43 located at the rear end of the central first segment 21. The rear third segment 42 may be connected to the back support 12 through a further linkage 25. The further linkage 25 may include a link 46 which is fitted to a pin 47 fixed to the backrest support 12 and another pin 48 fixed to the rear edge of the rear third segment 42. The front second segment 21 may be pivotally connected to the pivot 23 located at a front end of the central first section 21. The front second segment 21 may be connected to the base support 11 through a linkage 25. The linkage 25 may include a link 26 which is fitted to a pin 27 fixed to the base support 11 and another pin 28 at the front edge of the second segment 22.

When the backrest is reclined, the central first segment 21 of the seat rises together with the seat support 13. The rear third segment 42 is forced by link 46, connected to the backrest support 12, to pivot on pivot 43 with the result that a rear end of the rear third segment 42 is pulled downward relative to the first segment 21. At the same time, the frontal second segment 22, connected to the base support 11 through the linkage 25, is forced by the linkage 25 to pivot on pivot 23 with the result that a front end of the front second segment 22 is pulled down. This combined effect concurrently mitigates shear effect and back compression and knee and heel rise.

The articulated connection(s) 23, 43 between the segments of the segmented members may be implemented in any one of a variety of ways, as will be explained in more detail with reference to FIG. 8 to FIG. 16. The articulated connection(s) 23, 43 may include a hinge. The articulated connection(s) 23, 43 may include a resiliently deformable portion interposed between the segments of the segmented member. Generally, the articulated connection(s) 23, 43 may be configured such that a torsion stiffness for pivoting the second segment relative to the first segment is much smaller than a torsion stiffness of the first segment and a torsion stiffness of the second segment.

Figure 8:
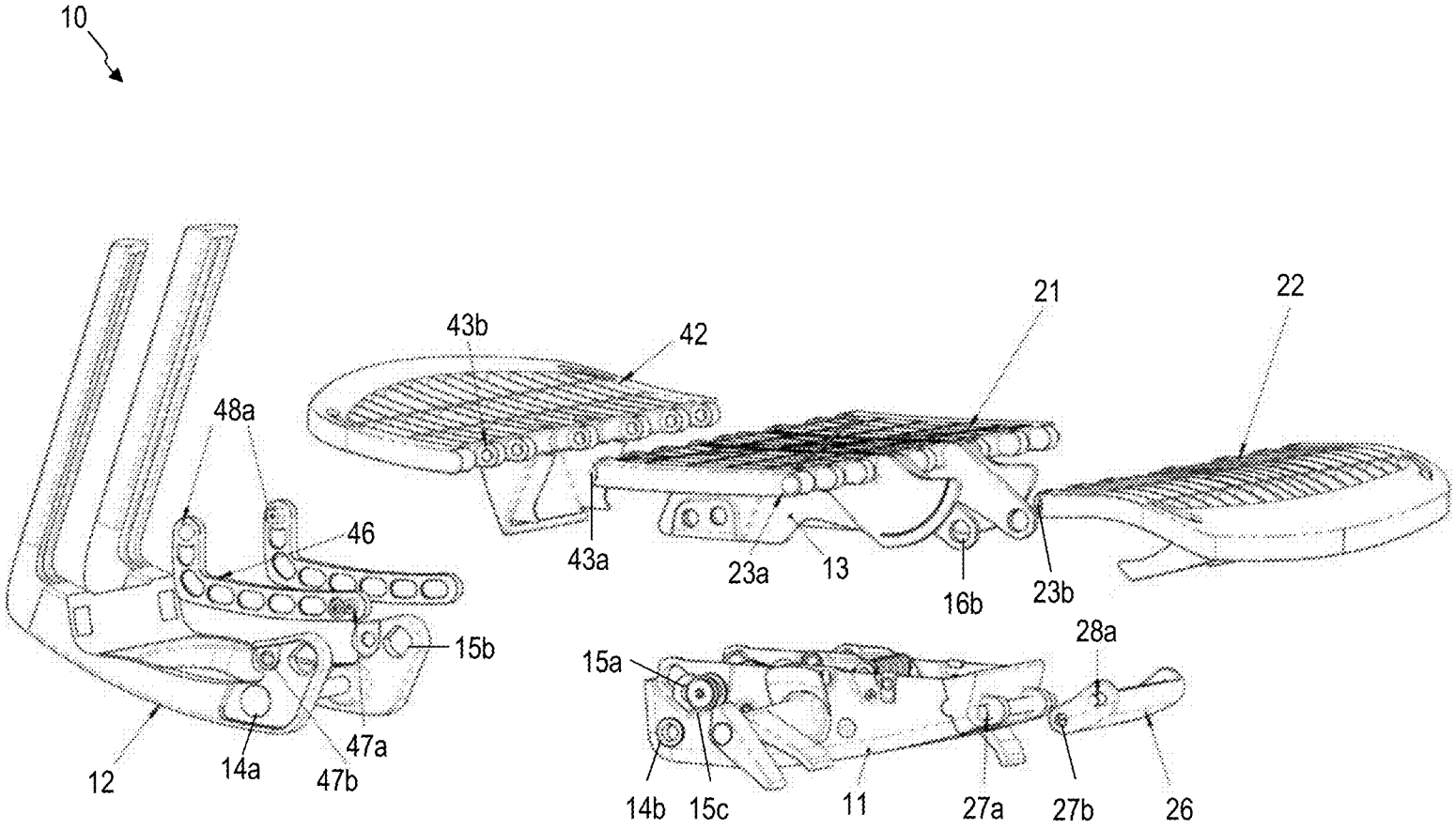
FIG. 8 is an exploded perspective view of the tilt mechanism of FIG. 6.

FIG. 8 is an exploded view of the tilt mechanism 10 of FIG. 6 and FIG. 7.

In order to provide weight responsive recline characteristics, the back support 12 may have a projection 14*a* which is rotatably received in a recess 14*b* on the base. The connection 15 between the backrest support 12 and the seat support 13 may include a pin 15*a* which is attached to or integrally formed with one of the backrest support 12 and the seat support 13. The pin 15*a* may extend through a slot 15*b* provided in the other one of the backrest support 12 and the seat support 13. The pine 15*a* may extend through a further slot 15*c* provided in the base support 11, so as to define a travel path of the seat support 13 relative to the base support 11 when the backrest support 12 undergoes a recline motion. The slot 15*b* and the further slot 15*c* may be angled relative to each other. When the backrest support 12 is in its frontmost position, one of the slot 15*b* and the further slot 15*c* may be angled downward in the rearward-forward direction, and the other one of the slot 15*b* and the further slot 15*c* may be angled upward in the rearward-forward direction of the tilt mechanism.

The articulated connection 23 of the segmented member may be formed by a hinge. Projections 23*a* provided on the first segment 21 may be rotatably received in mating recesses 23*b* provided on the second segment 22. In another implementation, projections provided on the second segment 22 may be rotatably received in mating recesses provided on the first segment 21.

Alternatively or additionally, the articulated connection 43 of the segmented member may be formed by a hinge. Projections 43*a* provided on the first segment 21 may be rotatably received in mating recesses 43*b* provided on the third segment 42. In another implementation, projections provided on the third segment 42 may be rotatably received in mating recesses provided on the first segment 21.

The linkage 25 and/or the further linkage 45 may have various configurations. For illustration, the link 26 of the linkage 25 may be pivotably connected to both the base support 11 and the second segment 22. A pin 27*a* provided on one of the base support 11 and the link 26 may be received in a mating hole 27*b* provided on the other one of the base support 11 and the link 26. A pin 28*a* provided on one of the link 26 and the second segment 22 may be received in a mating hole 28*b* provided on the other one of the second segment 22 and the link 26. One or both of the holes 27*b*, 28*b* may be circular or may be formed as slots to allow the pins 27*a*, 28*a* to slide therein. This allows the tilt mechanism to be configured such that the second segment 22 is pivoted downward relative to the first segment 21 when the first segment 21 reaches a threshold height, for example.

Similarly, the further linkage 45 may be configured such that the link 46 of the further linkage 45 may be pivotably connected to both the backrest support 12 and the third segment 42. A pin 47*a* provided on one of the backrest support 12 and the link 46 may be received in a mating hole 47*b* provided on the other one of the backrest support 12 and the link 46. A pin 48*a* provided on one of the link 46 and the third segment 42 may be received in a mating hole 48*b* provided on the other one of the third segment 42 and the link 46. One or both of the holes 47*b*, 48*b* may be circular or may be formed as slots to allow the pins 47*a*, 48*a* to slide therein. This allows the tilt mechanism to be configured such that the third segment 42 is pivoted downward relative to the first segment 21 when the first segment 21 reaches a threshold height, for example.

A configuration of the articulated connection 23 and the linkage 25 as illustrated in FIG. 8 may be used also in the tilt mechanism 10 of FIG. 2 and FIG. 3, i.e., in a tilt mechanism in which only the front segment of the seat is pivoted downward. A configuration of the articulated connection 43 and the further linkage 45 as illustrated in FIG. 8 may be used also in the tilt mechanism 10 of FIG. 4 and FIG. 5, i.e., in a tilt mechanism in which only the rear segment of the seat is pivoted downward.

Figure 9:
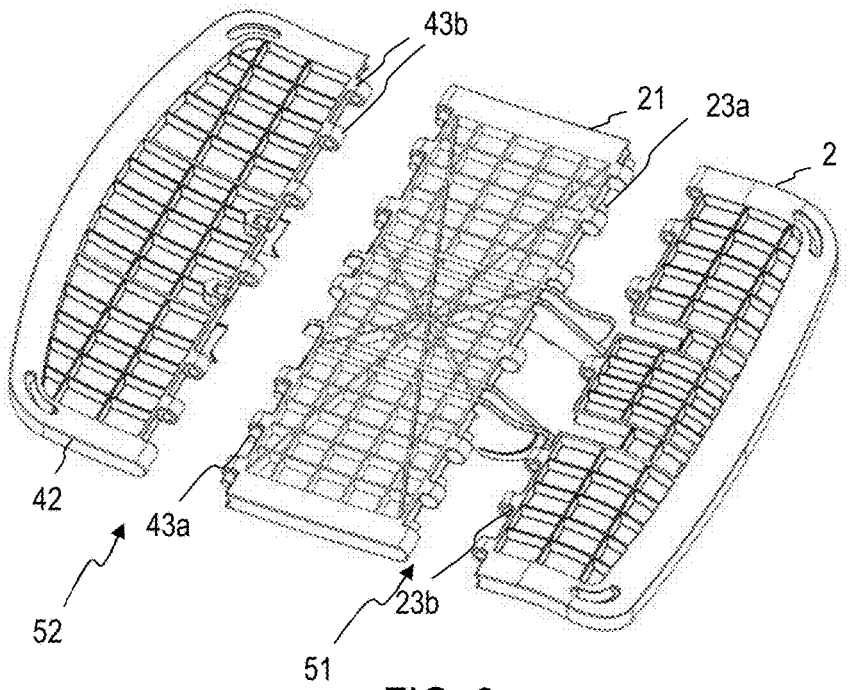
FIG. 9 is an exploded partial view of the tilt mechanism of FIG. 6.
Figure 10:
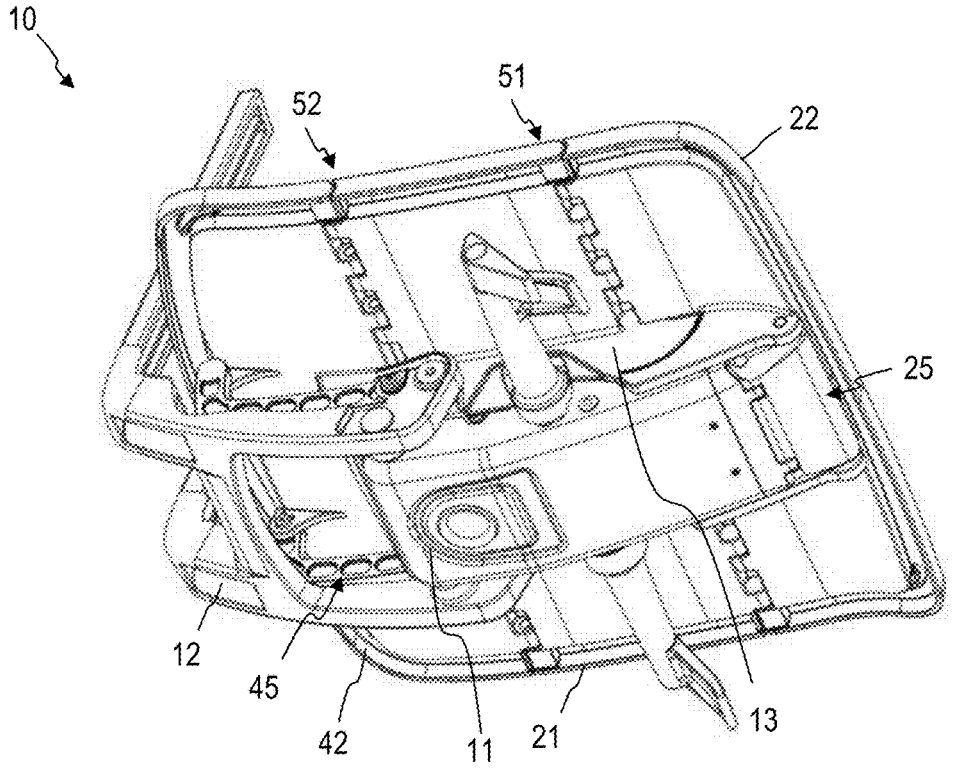
FIG. 10 is a perspective view of the tilt mechanism of FIG. 6.

FIG. 9 is an exploded partial view of a segmented member which may be used in the tilt mechanism 10 of any one of FIG. 6 to FIG. 8. FIG. 10 is a perspective bottom view of the tilt mechanism of FIG. 6 to FIG. 8.

The articulated connection(s) of the segmented member are formed by a hinge 51, 52. The hinge 51 may include projections 23*a* provided on the first segment 21 which are rotatably received in mating recesses 23*b* provided on the second segment 22. In another implementation, projections provided on the second segment 22 may be rotatably received in mating recesses provided on the first segment 21.

The hinge 52 may include projections 43*a* provided on the first segment 21 which are rotatably received in mating recesses 43*b* provided on the third segment 42. In another implementation, projections provided on the third segment 42 may be rotatably received in mating recesses provided on the first segment 21.

Figure 11:
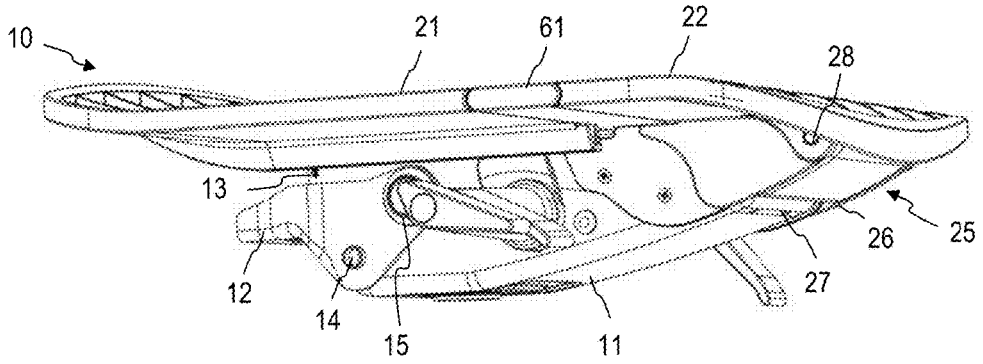
FIG. 11 is a perspective view of a tilt mechanism according to an embodiment.
Figure 12:
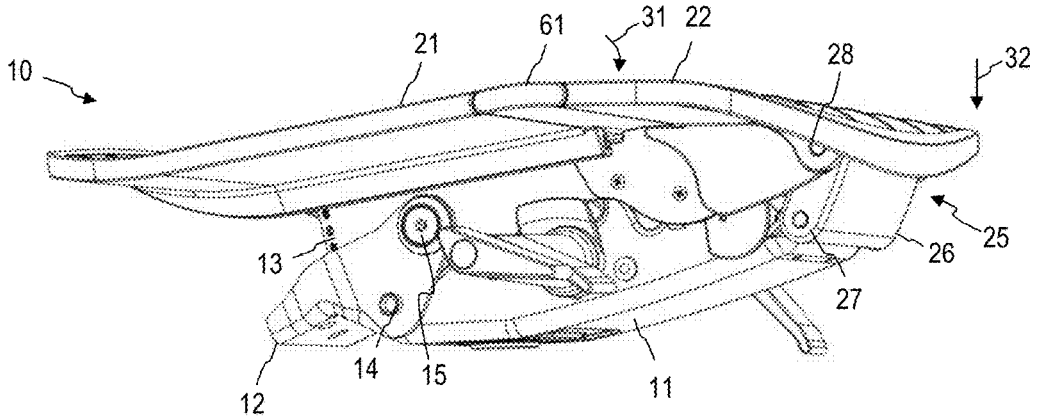
FIG. 12 is a perspective view of the tilt mechanism of FIG. 11 when the backrest support is reclined.
Figure 13:
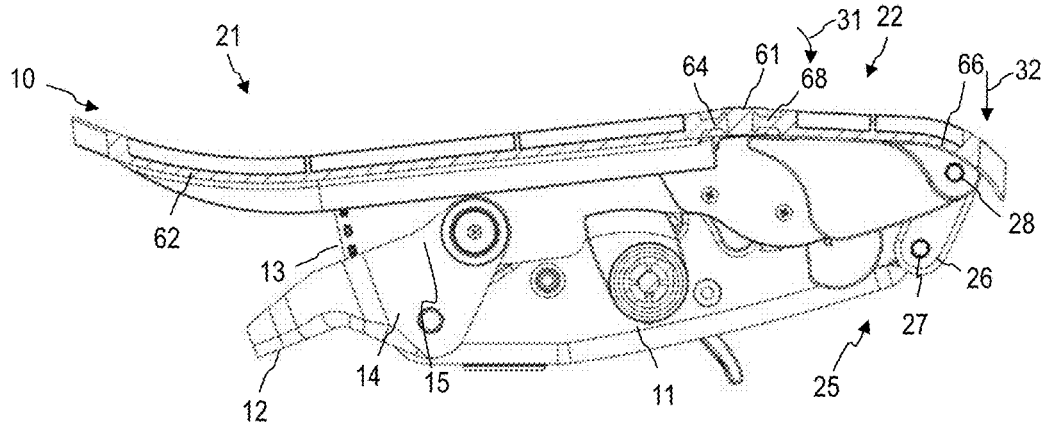
FIG. 13 is a partial cross-sectional view of the tilt mechanism of FIG. 11 when the backrest support is reclined.

FIG. 11 is a perspective view of a tilt mechanism 10 according to an embodiment when the backrest support 12 is in a position which corresponds to the frontmost backrest position. FIG. 12 is a perspective view of the tilt mechanism of FIG. 11 when the backrest support 12 is in a reclined position. FIG. 13 is a partial sectional view of the tilt mechanism of FIG. 11 when the backrest support 12 is in a reclined position.

In the tilt mechanism 10 of FIG. 11 to FIG. 13, the segmented member includes an articulated connection which is formed by a resilient section 61 which is sandwiched between the first segment 21 and the second segment 22.

The resilient section 61 may extend through the segmented member in a lateral direction, which corresponds to the left-right direction in the installed state of the tilt mechanism.

The resilient section 61 may have a thickness which is the same or which is smaller than a thickness of the first segment 21 and the second segment 22.

The resilient section 61 may be formed from a plastic material, e.g. from rubber. The resilient section 61 may be integrally formed with or attached to the first segment 21 and the second segment 22. The resilient section 61 may have a torsion stiffness for rotations about an axis which extends in the lateral horizontal axis which is less than a torsion stiffness of both the first segment 21 and the second segment 22.

The segmented member may include a material 62 having a higher rigidity than the resilient section 61 to from the first segment 21. The segmented member may include a material 66 having a higher rigidity than the resilient section to form the second segment 22. Reinforcements may optionally be embedded in the material 62 and/or reinforcement ribs may be formed on the material 62 to provide the first segment 21 with a torsion stiffness which is greater than that of the resilient section 61. Reinforcements may be embedded in the material 66 and/or reinforcement ribs may be formed on the material 66 to provide the second segment 22 with a torsion stiffness which is greater than that of the resilient section 61.

The first segment 21 may have anchoring features 64 which secure the first segment 21 to the resilient section 61. The second segment 22 may have anchoring features 68 which secure the second segment 22 to the resilient section 61.

Other configurations may be used. For illustration, the anchoring features 64, 68 may also be omitted when the segmented member is formed by embedding reinforcements 65, 67 into a unitary resilient material to form the first segment 21 and the second segment 22 connected by the resilient section 61.

When the backrest support 12 moves to a reclined position, the second segment 22 pivots relative to the first segment 21 by virtue of the resilient material articulation. The resilient material articulation may be provided between seats portions so as to extend through the segmented member in a width direction of the seat. The resilient material articulation may adapt itself to the movements imposed by the linkage 25 while the user tilts back.

A resilient material articulation as explained with reference to FIG. 11 to FIG. 13 may be used in any one or both of the articulated connections 23, 43 of the tilt mechanisms of FIG. 2 to FIG. 10.

Figure 14:
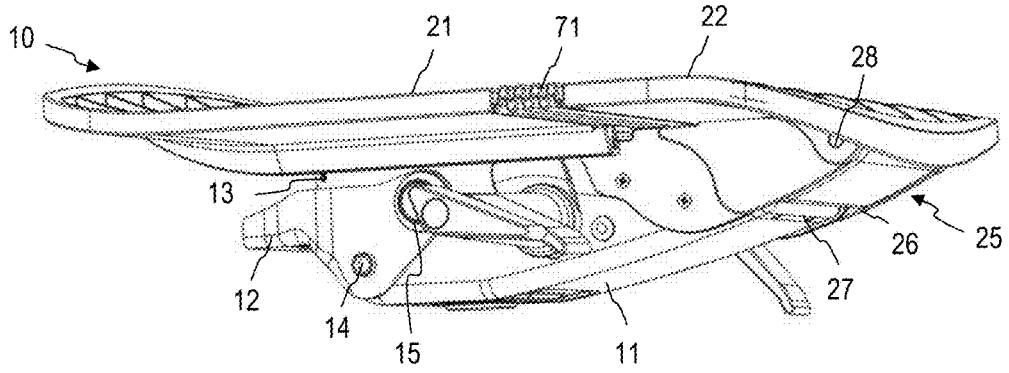
FIG. 14 is a perspective view of a tilt mechanism according to an embodiment.
Figure 15:
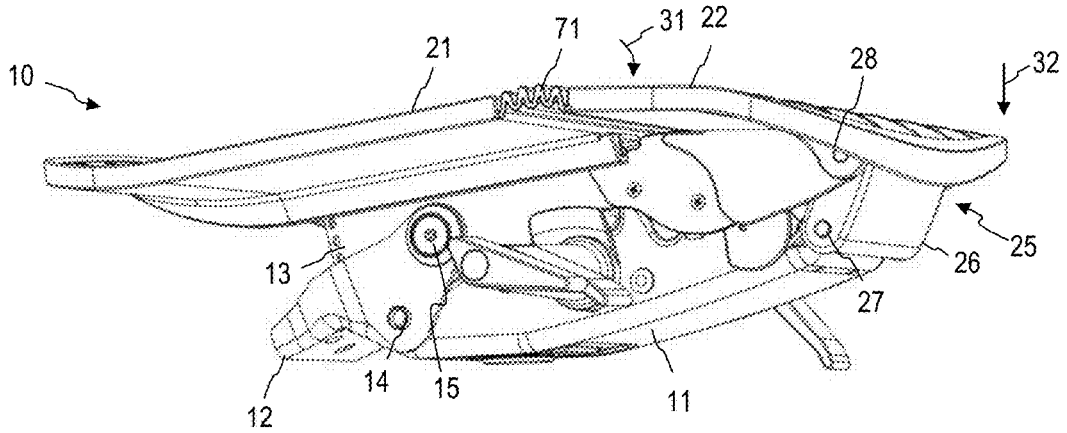
FIG. 15 is a perspective view of the tilt mechanism of FIG. 14 when the backrest support is reclined.
Figure 16:
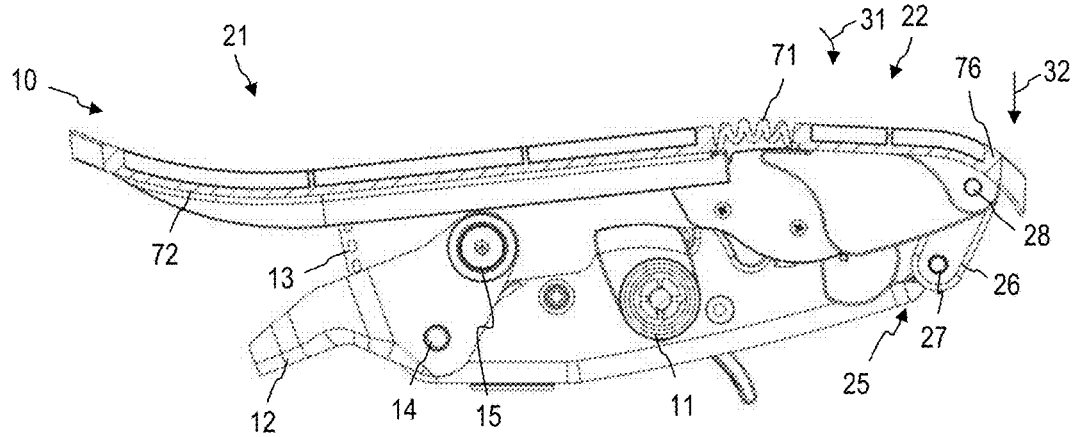
FIG. 16 is a partial cross-sectional view of the tilt mechanism of FIG. 14 when the backrest support is reclined.

FIG. 14 is a perspective view of a tilt mechanism 10 according to an embodiment when the backrest support 12 is in a position which corresponds to the frontmost backrest position. FIG. 15 is a perspective view of the tilt mechanism of FIG. 14 when the backrest support 12 is in a reclined position. FIG. 16 is a partial sectional view of the tilt mechanism of FIG. 14 when the backrest support 12 is in a reclined position.

In the tilt mechanism 10 of FIG. 14 to FIG. 16, the segmented member includes an articulated connection which is formed by a resilient section 71 which is sandwiched between the first segment 21 and the second segment 22.

The resilient section 71 may extend through the segmented member in a lateral direction, which corresponds to the left-right direction in the installed state of the tilt mechanism.

The resilient section 71 may have a thickness which is the same or which is smaller than a thickness of the first segment 21 and the second segment 22. The resilient section 71 may have an undulated shape, with the apices of the undulated shape extending in the lateral direction of the tilt mechanism.

The resilient section 71 may be formed from a plastic material, e.g. from rubber. The resilient section 71 may be integrally formed with or attached to the first segment 21 and the second segment 22. The resilient section 71 may have a torsion stiffness for rotations about an axis which extends in the lateral horizontal axis which is less than a torsion stiffness of both the first segment 21 and the second segment 22.

The segmented member may include a material 72 which forms the first segment 21 and which has a higher rigidity than the resilient section 71. The segmented member may include a material 76 which forms the second segment 22 and which has a higher rigidity than the flexible section 71. The material may form the flexible section 71 which joins the first segment 21 and the second segment 22. Reinforcements may be embedded in the material 72 and/or may be formed on the material 72 to provide the first segment 21 with a torsion stiffness which is greater than that of the resilient section 71. Reinforcements may be embedded in the material 76 and/or may be formed on the material 76 to provide the second segment 22 with a torsion stiffness which is greater than that of the resilient section 71.

The tilt mechanism may be configured such that it allows a seat depth to be adjusted. According to conventional terminology in the art, seat depth adjustment refers to a configuration which allows the seat position to be varied, e.g. relative to the base support 11, in the forward-rearward direction. While a tilt mechanism configured for seat depth adjustment will be explained with reference to FIG. 17 to FIG. 24 in the context of a segmented member which has a pivotable front section to reduce knee and heel rise, the tilt mechanisms are not limited thereto. For illustration, the tilt mechanisms which are configured to mitigate back shear and compression effects may also have features which allow the seat depth to be adjusted.

Figure 17:
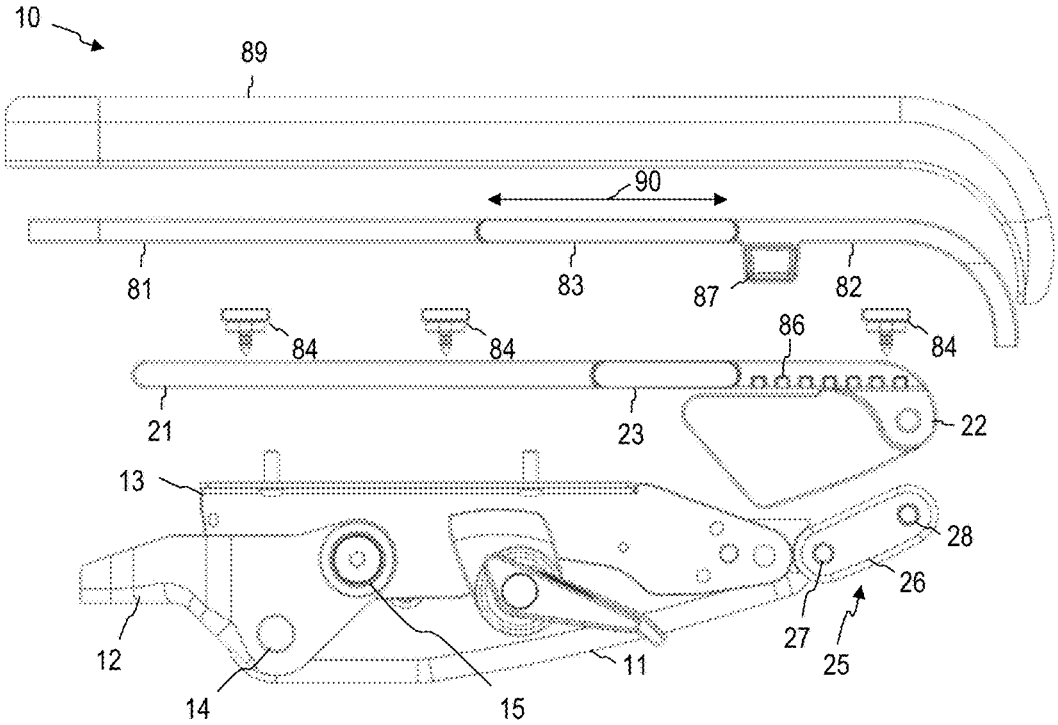
FIG. 17 is an exploded side view of a tilt mechanism according to an embodiment.
Figure 18:
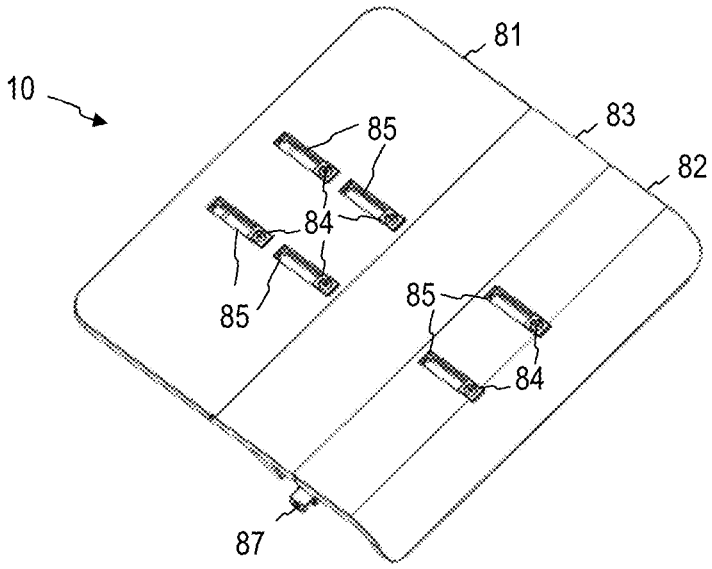
FIG. 18 is a partial plan view of the tilt mechanism of FIG. 17.
Figure 19:
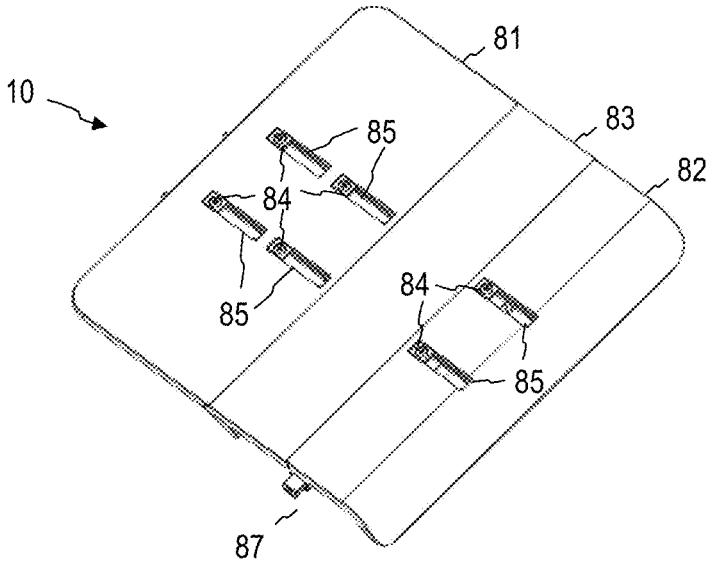
FIG. 19 is a partial plan view of the tilt mechanism of FIG. 17 with adjusted seat depth.

FIG. 17 is an exploded side view of a tilt mechanism 10 according to an embodiment. FIG. 18 is a perspective partial view of the tilt mechanism 10 for one seat depth and FIG. 19 is a perspective partial view of the tilt mechanism 10 for another seat depth.

The tilt mechanism 10 comprises a base support 11, a back support 12, and a seat support 13 which are configured to provide weight-responsive recline characteristics. The tilt mechanism 10 comprises a segmented member. The segmented member has a first segment 21 and a second segment 22 coupled to the first segment 21 via an articulated connection 23. A linkage 25 is configured to pivot the second segment relative to the first segment 21 when the seat support 13 is raised by a recline motion of the backrest support 12. The first segment 21 may be rigidly attached to the seat support 13. The segmented member and linkage may have any one of the configurations explained with reference to FIG. 1 to FIG. 16 above.

A seat of the tilt mechanism 10 comprises a slider system which allows the seat to slide forward and rearward relative to the base support 11. The slide system may comprise sliders 84 which are attached to the segmented member. The sliders 84 may be received in guide recesses 85 which are best seen in FIG. 18 and FIG. 19. As will be explained in more detail below, at least one of the sliders 84 is provided on the first segment 21 and at least another one of the sliders 84 is provided on the second segment 22.

A seat of the tilt mechanism may be configured to adjust itself in accordance with the pivoting motion of the second segment 22 relative to the first segment 21. The seat may include a segmented support. The sliding panel may be overlaid on the segmented member in an abutting relationship. The sliding panel may include a first sliding panel segment 81, a second sliding panel segment 82, and an articulated connection 83. The second sliding panel segment 82 may be pivotable relative to the first sliding panel segment 81 by virtue of the articulated connection 83. The seat may include upholstery, padding or cover material overlaid on the segmented support.

The articulated connection 83 may have a length 90 measured in the forward-rearward direction of the tilt mechanism which is greater than a length of the articulated connection 23 of the segmented member measured in the forward-rearward direction. Either one or both of the articulated connection 83 of the sliding panel and the articulated connection 23 of the segmented member may be configured as explained with reference to FIG. 11 to FIG. 16, for example.

As best seen in FIG. 18 and FIG. 19, the sliding panel includes guide slots 85 in which the sliders 84 are slidably received. The guide slots 85 may have a length, measured in the forward-rearward direction of the tilt mechanism, which corresponds to the distance by which the seat may travel in the forward-rearward direction. The guide slots 85 may respectively have a length measured in the forward-rearward direction of the tilt mechanism which is less than the length 90 of the articulated connection 83 of the segmented support.

At least one of the guide slots 85 is configured to receive a slider 84 provided on the first segment 21 of the segmented member. At least another one of the guide slots 85 is configured to receive another slider 84 provided on the second segment 22 of the segmented member.

The sliders 84 and guide slots 85 may be configured such that the slider 84 provided on the second segment 22 of the segmented member is operative to exert a downward force onto the second sliding panel segment 82.

The slider system which comprises the guide slots 85 and the sliders 84 received therein allows the seat to be displaced. The guide slots 85 move over the sliders 84. Ends of the guide slots 85 act as end stops for the movement of the seat.

The slider system may be configured to lock the seat in position in the forward-rearward direction. An activation member 87 for locking the seat may be provided. Activation of the activation member 87 causes engagement with a locking feature 86 provided on the segmented member. The activation member 87 may be provided on the pivotable second sliding panel segment 82. The locking feature 86 may be provided on the pivotable second segment 22.

The tilt mechanism 10 is configured such that the articulated connection 83 remains positioned above the articulated connection 23 for any position to which the seat may be adjusted in the forward-rearward direction. The length 90 of the articulated connection 83 may be set in dependence on the desired travel of the seat so as to ensure that the articulated connection 83 remains positioned above the articulated connection 23 for any position to which the seat may be adjusted in the forward-rearward direction. This allows the seat to adjust when the second segment 22 is pivoted relative to the first segment 21 to reduce upward travel of the front end of the second segment 22.

The slider(s) 84 attached to the second segment 22 and received in guide slots 85 on the second sliding panel segment 82 are operative to exert a force onto the second sliding panel segment 82 in a downward direction. A lower end face of the slider(s) 84 may abut on a surface of the guide slot to exert the downward force onto the second sliding panel segment 82. The front end of the seat may thereby be pulled downward to limit upward travel of the front end of the seat.

Figure 20:
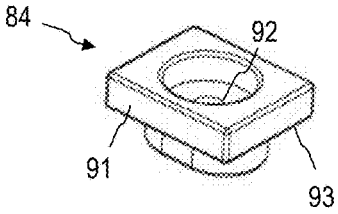
FIG. 20 is an enlarged perspective view of a slider of the tilt mechanism of FIG. 17.

FIG. 20 is an enlarged perspective view of a slider 84 which may be attached to or integrally formed with the second segment 22. The slider 91 has side faces 91 for abutting contact with the guide slot 85. The slider 91 may have a central opening 92 for attachment to the second segment 22, e.g. via a bolt or threaded connection. The slider 91 has a lower face 93 configured to abut on a face of the guide slot 85, so as to pull the second sliding panel segment 82 downward relative to the first sliding panel segment 81 when the linkage 25 pivots the second segment 22 relative to the first segment 21.

Figure 21:
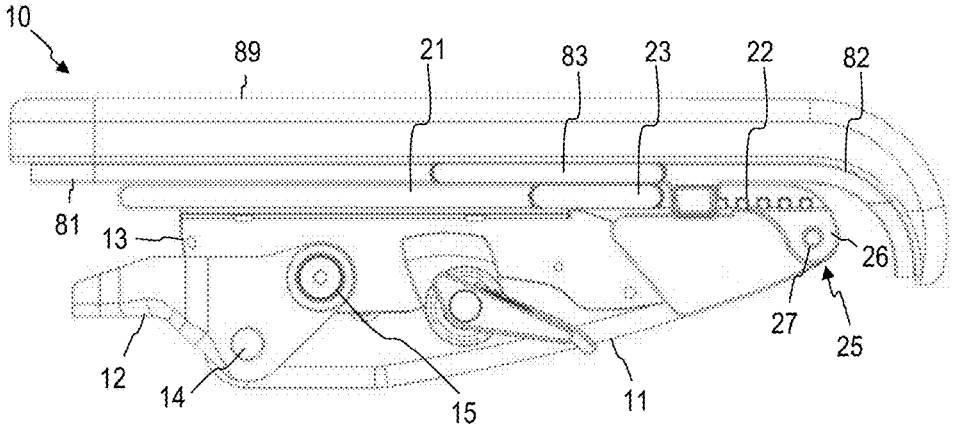
FIG. 21 is a side view of the tilt mechanism of FIG. 17 when the seat is at a rearmost position.
Figure 22:
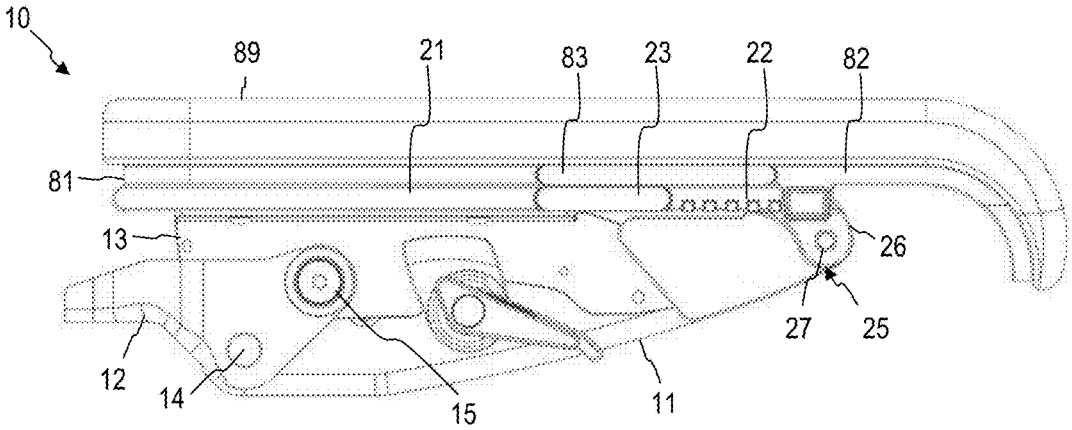
FIG. 22 is a side view of the tilt mechanism of FIG. 17 when the seat is moved to a frontmost position by a seat depth adjustment.
Figure 23:
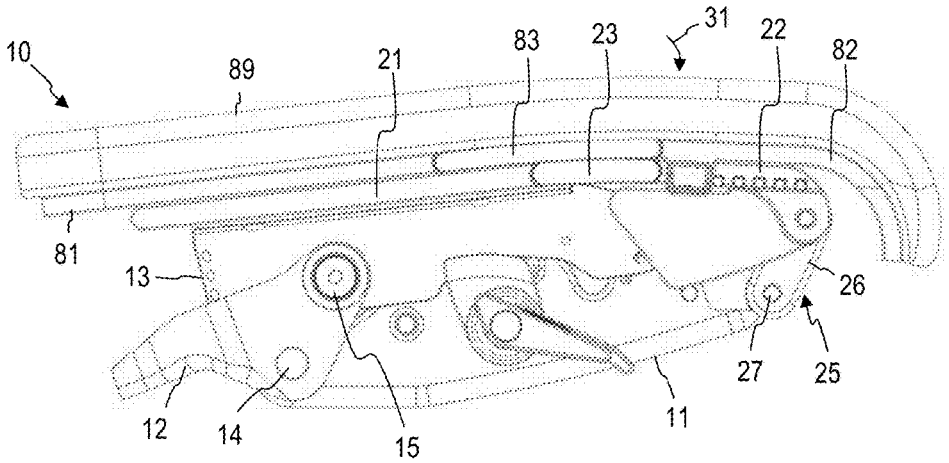
FIG. 23 is a side view of the tilt mechanism of FIG. 17 when the seat is at a rearmost position and the backrest support is reclined.
Figure 24:
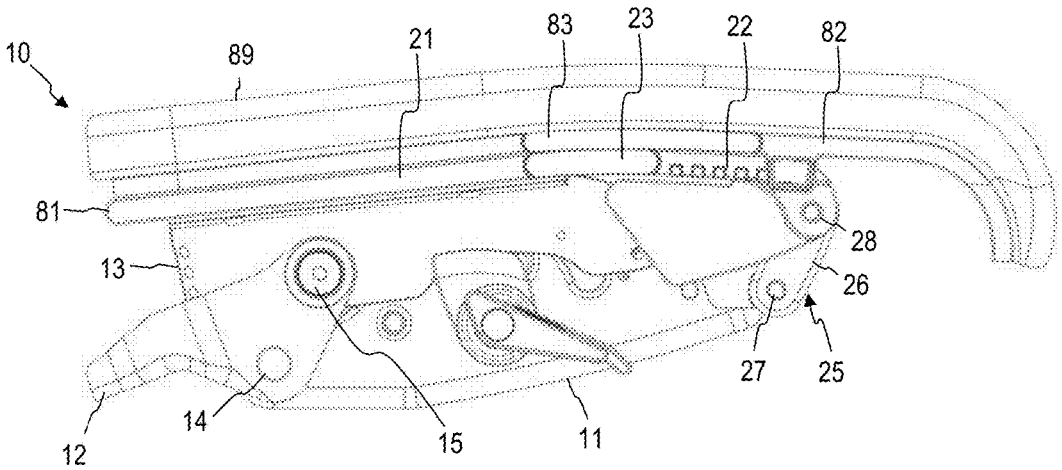
FIG. 24 is a side view of the tilt mechanism of FIG. 17 when the seat is moved to a frontmost position by a seat depth adjustment and the backrest support is reclined.

Operation of the tilt mechanism 10 will be explained in more detail with reference to FIG. 21 to FIG. 24. FIG. 21 shows the tilt mechanism 10 of FIG. 17 when the backrest is not reclined and the seat is in a rearmost position relative to the base support. FIG. 22 shows the tilt mechanism 10 of FIG. 17 when the backrest is not reclined and the seat is in a frontmost position relative to the base support. FIG. 23 shows the tilt mechanism 10 of FIG. 17 when the backrest is reclined and the seat is in the rearmost position relative to the base support. FIG. 24 shows the tilt mechanism 10 of FIG. 17 when the backrest is reclined and the seat is in the frontmost position relative to the base support.

As best seen in FIG. 21 and FIG. 22, the articulated connection 83 of the sliding panel remains positioned above the articulated connection 23 of the segmented member 20 for any position of the seat when the seat is displaced in the forward-rearward position.

When the backrest support 12 performs a recline movement, as shown in FIG. 23 and FIG. 24, the first segment 21 and the first sliding panel segment 81 are raised by the upward movement of the seat support 13. The linkage 25 pivots the second segment 22 relative to the first segment 21. The slider system causes the second sliding panel segment 82 to be pulled downward relative to the first sliding panel segment 81 when the linkage 25 pivots the second segment 22 relative to the first segment 21.

When the backrest support 12 moves back to a position which it is not reclined, the linkage 25 causes the second segment 22 to pivot upward relative to the first segment 22. Abutment of the second segment 22 on the second sliding panel segment 82 returns the second sliding panel segment 82 to the position shown in FIG. 21 and FIG. 22, respectively.

As seen in FIG. 21 and FIG. 23, when the seat is in a rearmost position, the articulated connection 23 of the segmented member overlaps with a front portion of the articulated connection 83. As seen in FIG. 22 and FIG. 24, when the seat is in a frontmost position, the articulated connection 23 of the segmented member overlaps with a rear portion of the articulated connection 83. This ensures that the seat adapts to the configuration of the segmented member irrespective of how it is positioned in the forward-rearward direction relative to the base support 11.

The tilt mechanism according to embodiments may be configured to allow an adjustment in depth of the seat. In some embodiments, the segmented may be an intermediate member interposed between the seat support 13 and the seat. The first segment 21, which may be the rear segment, of the segmented member may be directly connected to the seat support 13. The second segment 22, which may be the front segment, may be pivotally linked to the base support 11 via a link 26 and a pin 27 provided on the link 26. The second segment may be connected through a resilient articulation 23 to the rear segment.

When tilting back, the first segment 21 rises together with the seat support 13, while the second segment 22 connected to the base support 11 is forced by link 26 to pivot downward. A front end of the second segment 22 may be pulled down, mitigating knee and heel rise.

The segmented member 21-23 may be surmounted by the resilient sliding panel. The resilient sliding panel may comprise a front section 82, a rear section 81 and a central section 83. The resilient sliding panel may follow the articulation of the segmented member during backrest recline. The sliding panel automatically adapts itself to the seat depth chosen by the user. The sliding panel can be positioned forward or rearward because of the slots 85 in its sections which receive the sliders 84. The sliding panel can also be locked in a preferred position thanks to a button or other activation member 87 on its front section 82. Activation of the activation member 87 may cause engagement with a locking rack 86 on the second segment 22.

The tilt mechanism according to any one of the various embodiments may be configured such that it can be easily installed on seating furniture even when there is no central support column. The tilt mechanism may include two mechanisms which each have at least one link forming the seat support. The two mechanisms may be installed on lateral sides of the seating furniture to provide a weight-responsive recline characteristics. A linkage acts on a segmented member to mitigate at least one of knee and heel rise or back compression.

Figure 25:
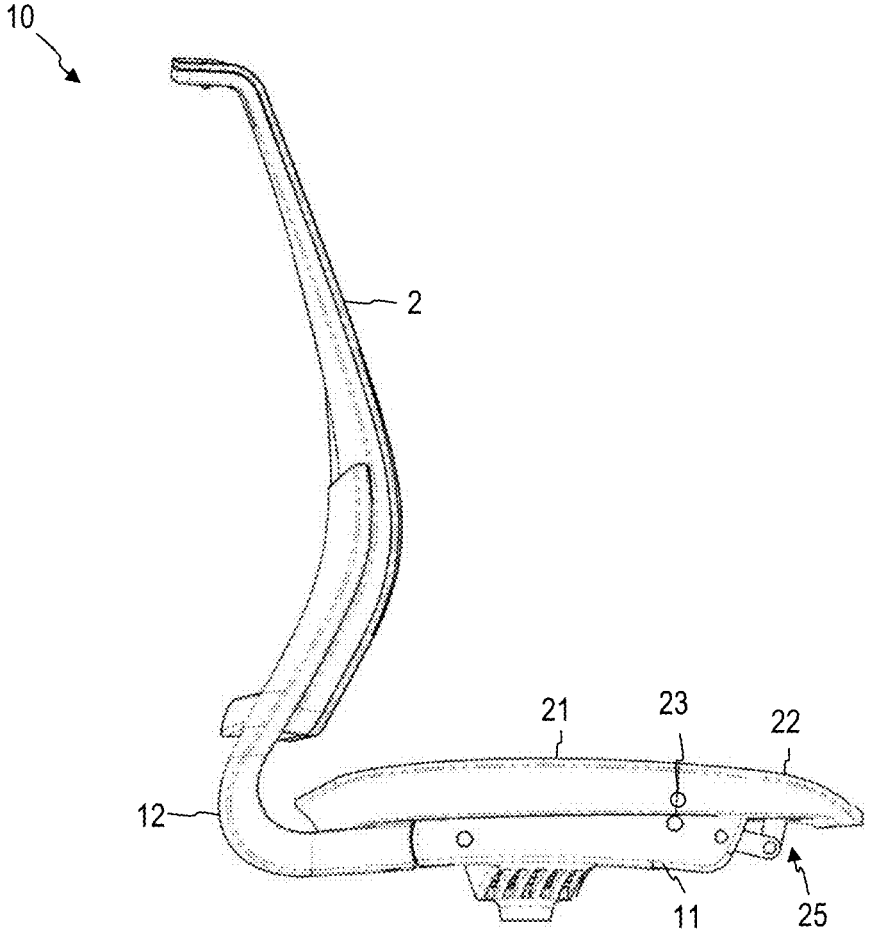
FIG. 25 is a side view of a tilt mechanism according to an embodiment.
Figure 26:
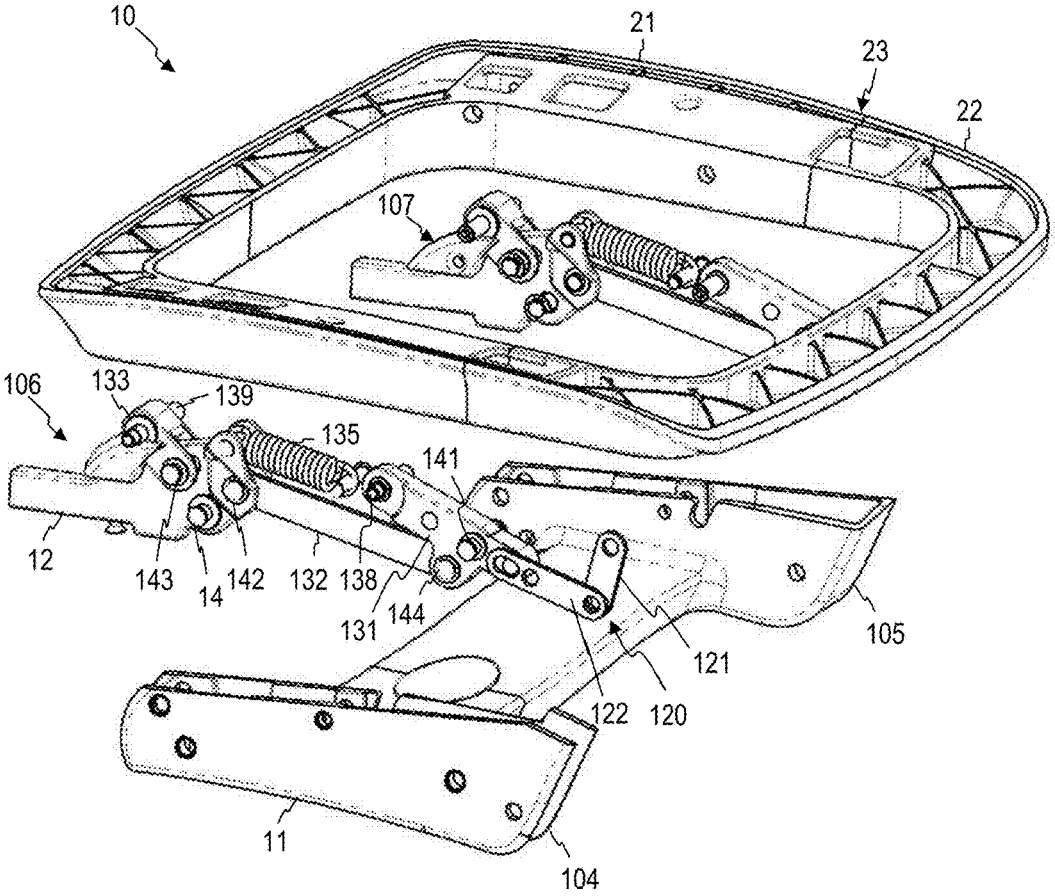
FIG. 26 is an exploded perspective view of the tilt mechanism of FIG. 25.
Figure 27:
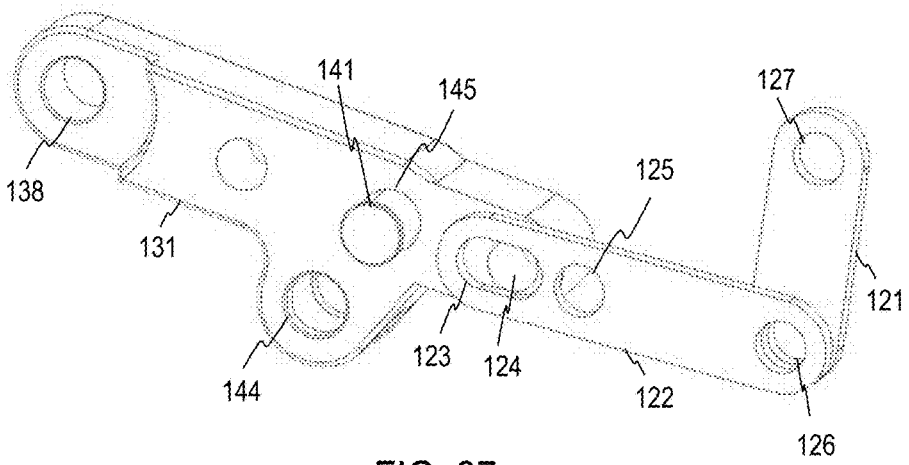
FIG. 27 is an enlarged perspective view showing a linkage of the tilt mechanism of FIG. 25.
Figure 28:
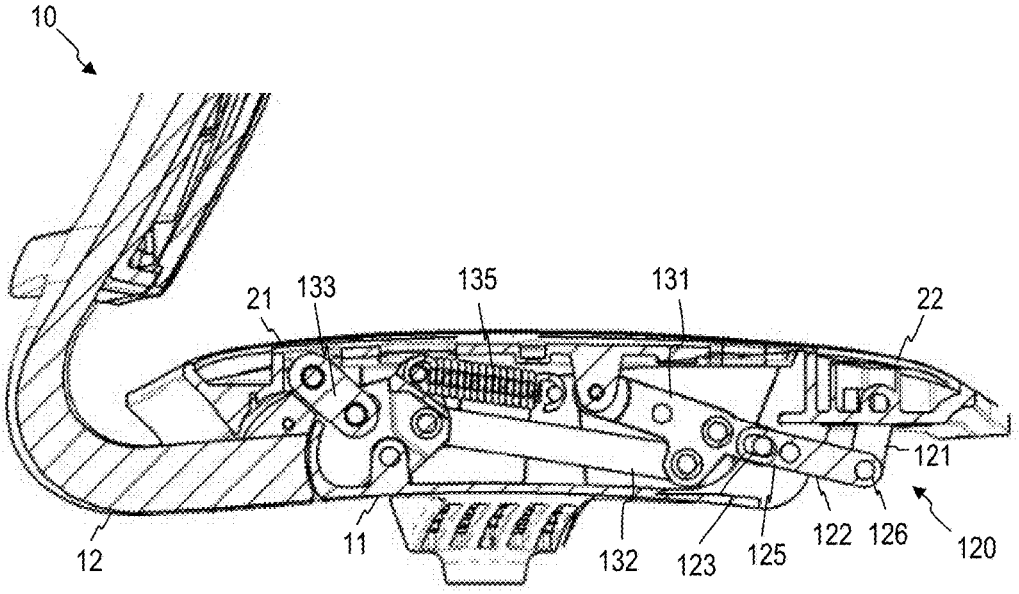
FIG. 28 is a partially broken-away side view of the tilt mechanism of FIG. 25.
Figure 29:
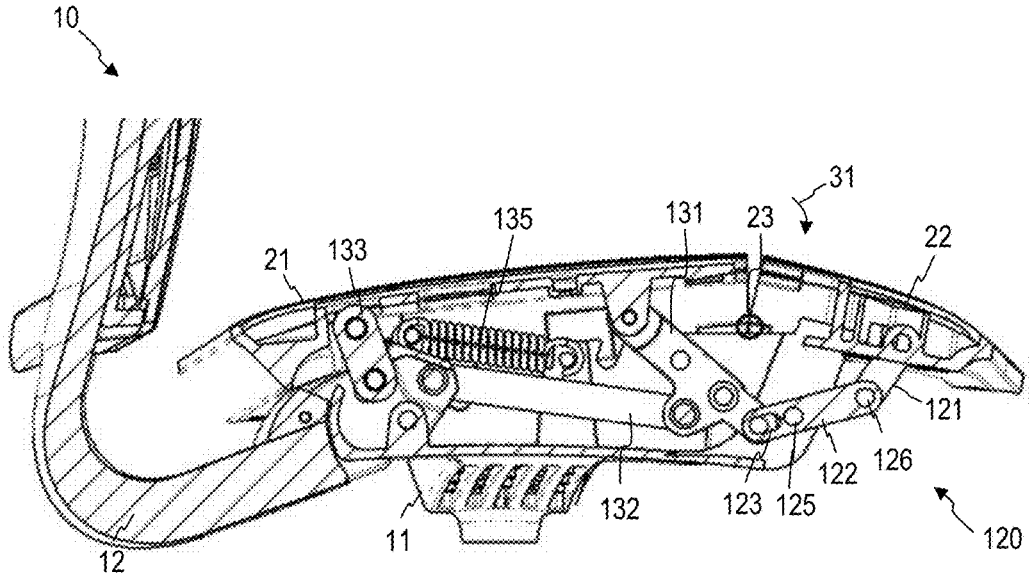
FIG. 29 is a partially broken-away side view of the tilt mechanism of FIG. 25 when the backrest support is reclined.
Figure 30:
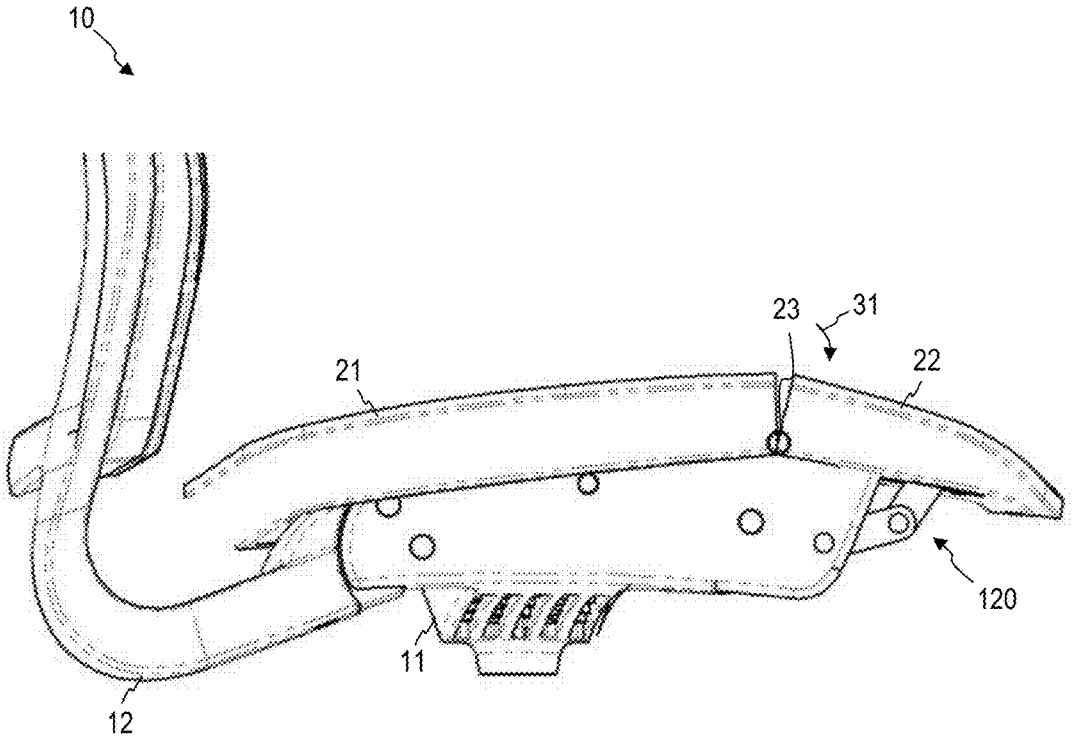
FIG. 30 is a side view of the tilt mechanism of FIG. 25 when the backrest support is reclined.

FIG. 25 is a side view of a tilt mechanism 10 according to an embodiment. FIG. 26 is an exploded perspective view of the tilt mechanism 10 of FIG. 25. FIG. 27 is an enlarged partial perspective view of the tilt mechanism 10 of FIG. 25. FIG. 28 and FIG. 29 are partially broken-away side views showing the tilt mechanism 10 when the backrest is not reclined and when the backrest is reclined, respectively. FIG. 30 is a side view of the tilt mechanism of FIG. 25 when the backrest is reclined.

The tilt mechanism 10 of FIG. 25 to FIG. 30 includes a base support 11, a backrest support 12, a seat support 13, and a segmented member. The segmented member may define a support surface for the user's weight and may form the seat or may be interposed between the seat and the seat support. The segmented member includes a first segment 21 which moves jointly with the seat support and a second segment 22 which is articulated to the first segment 21 via an articulated connection 23. The articulated connection 23 may have any one of a variety of configurations as explained above. A linkage 25 causes the second segment 22 to pivot relative to the first segment 21 when the first segment 21 is displaced relative to the base support 11.

The tilt mechanism 10 of an embodiment has a base support 11. The base support 11 may be fixedly attached to the base assembly 4. The base support 11 may define two receptacles 104, 105 on lateral sides of the seating furniture. At least part of the mechanisms 106, 107 which will be described in more detail below may be accommodated in the receptacles 104, 105.

The tilt mechanism 10 includes a first recline mechanism 106 and a second recline mechanism 107 which are arranged on opposite lateral sides of the seating furniture. The first recline mechanism 106 and the second recline mechanism 107 generally have identical or mirror-symmetrical configurations. The configuration described with reference to the first recline mechanism 106 below may accordingly be implemented also in the second recline mechanism 107.

The first mechanism 106 has a first lever 131 and a third lever 133, which respectively are attached to the seat. The first lever 131 and the third lever 133 may be pivotably attached to the seat. The first lever 131 and the third lever 133 may be pivotably attached to the first segment 21 of the segmented member which is comprised by the seat or which is arranged to extend below the seat. The tilt mechanism 10 has a backrest support 12. In the installed state of the tilt mechanism 10, the backrest support 12 may be fixedly attached to the backrest 2. For illustration, the backrest support 12 may be attached to a lateral arm of the backrest 2. The tilt mechanism 10 may further have a second lever 132 which is pivotably attached to the first lever 131 and the backrest support 12. The second lever 132 may be operative to force the first lever 131 to pivot relative to the base support 11 when the backrest support 12 pivots relative to the base support 11. The movement of the seat induced by the movement of the first lever 131 also causes the third lever 133 to pivot relative to the base support 11. An energy storage mechanism, which may comprise a spring 135, is connected between the second lever 132 and the first lever 131 to provide a self-balancing function.

The small width in the lateral dimension allows the first recline mechanism 106 and/or second recline mechanism 107 to be partially hidden from view. For illustration, at least part of the first recline mechanism 106 may be arranged in a first lateral pocket and at least part of the second tilt mechanism 107 may be arranged in a second lateral pocket on the opposite lateral side of the seating furniture.

With the first and second recline mechanisms 106, 107 being installed at lateral sides of the seating furniture, the tilt mechanism may also be installed in chairs or other seating furniture which do not have a central support.

The receptacles 104, 105 may act as carriers for the first and second recline mechanisms 106, 107. When the tilt mechanism is installed, the carrier may be the fixed part of the recline mechanisms 106, 107. The receptacles 104, 105 may be attached to a chair such that the carrier remains stationary relative to a base assembly of the chair. The receptacles 104, 105 may have a U-shape configuration, with at least part of the first lever 31 and the second lever 32 being disposed within a cavity defined by the U-shape of the receptacles 104, 105. The U-shaped receptacles 104, 105 may comprise a first wall section and a second wall section parallel to the first wall section, with the first lever 31 and the second lever 32 entering a space between the first wall section and the second wall section of the receptacle 104 or of the receptacle 105.

The recline mechanism 106 comprises the first lever 131 configured to be attached to the seat of the chair. A first pivot axis 141 is positioned on a front part of the receptacle 104. The first lever 131 is pivotably attached to the receptacle 104 at the first pivot axis 141. The first lever 131 may pivot relative to the carrier about the first pivot axis 141. The first pivot axis 141 may have a fixed location relative to the receptacle 104. The first pivot axis 141 may comprise a pin which extends through an opening in the receptacle 104 and an opening in the first lever 131. The first lever 131 has a mount structure 138 for mounting the first lever 131 to the seat. The mount structure 138 may comprise a hole through which a pin 28 may be inserted to pivotably couple the first lever 131 to the seat. The first lever 131 may comprise a pair of walls, with the second lever 132 entering a space defined between the pair of walls of the first lever 131. In other embodiments, the second lever 132 may move along a side of the first lever 131 and the first lever 131 does not include a cavity. The first lever 131 may be arranged on the receptacle 104 such that the mount structure 138 is positioned rearward and upwardly of the first pivot axis 141 when the backrest is in the frontmost position. The recline mechanism 106 may be configured such that the mount structure 138 remains positioned rearward and upwardly of the first pivot axis 141 while the backrest is reclined from its frontmost position to its rearmost position.

The recline mechanism 106 comprises the second lever 132 which is pivotably attached to the backrest support 12 at a second pivot axis 142. The second pivot axis 142 may comprise a pin which projects through an opening in the backrest support 12 and an opening in the second lever 132. The second lever 132 is coupled to the first lever 131 by a coupling mechanism to pivot the first lever 131 about the first pivot axis 141 when the backrest support 12 pivots relative to the receptacle 104. The second lever 132 may be pivotably coupled to the first lever 131 at a fourth pivot axis 144. The fourth pivot axis 144 may comprise a pin which extends through an opening in the first lever 131 and through an opening in the second lever 132. The fourth pivot axis 144 and the second pivot axis 142 may be attached to the second lever 132 at opposite ends of the second lever 132.

The fourth pivot axis 144 may be provided at a fixed location on the first lever 131 and on the second lever 132. The fourth pivot axis 144 may project into a recess on the receptacle 104. The recess on the receptacle 104 may be a hole in which the fourth pivot axis 144 is rotatable. The recess defines a travel of the first lever 131 and, thus, of the seat attached to the first lever 131.

An energy storage mechanism is connected to the first lever 131 and the second lever 132. The energy storage mechanism may be or may comprise a spring 135. The energy storage mechanism may be connected to the first lever 131 adjacent to the mount structure 138. The energy storage mechanism may be connected to the second lever 132 towards a rear end of the second lever 132, e.g. adjacent to the second pivot axis 142. The opposite end of the energy storage mechanism may also be mounted in other ways, e.g. by attachment to the receptacle 104.

The recline mechanism 106 may comprise a third lever 133. The third lever 133 may also be configured to be attached to the seat. The third lever 133 may have a mount structure 139 for mounting the third lever 133 to the seat. The mount structure 139 may comprise a hole through which a pin 139 may be inserted to pivotably couple the third lever 133 to the seat. The third lever 133 may be arranged on the receptacle 104 such that the mount structure 139 is positioned rearward and upwardly of a third pivot axis 143 when the backrest is in the frontmost position. Both the third lever 133 and the backrest support 12 may pivot relative to the receptacle 104 when the backrest support 12 is reclined.

The recline mechanism 106 may be configured such that the backrest support 12 and the third lever 133 are caused to pivot in opposite directions. When the backrest support 12 is pivoted rearward during a recline motion of the backrest, the recline mechanism 106 may cause the third lever 133 to simultaneously pivot in a forward direction, thereby causing the seat to lift and to move forward. When the backrest support 12 is pivoted forwardly, the recline mechanism 106 may cause the third lever 133 to simultaneously pivot in a rearward direction, thereby causing the seat to be lowered and to move backward.

When a person sitting on the seat reclines the backrest, the backrest support 12 rotates in a recline movement. This causes a movement of the second pivot axis 142 about the third pivot axis 143. The second lever 132 is thereby actuated and transmits a rotational movement to the first lever 131. Movement of the second pivot axis 142 causes the fourth pivot axis 144 at the front portion of the second lever 132 to pivot about the first pivot axis 141. This movement of the fourth pivot axis 144 also leads to a rotation of the first lever 131 about the first pivot axis 141. The mount structure 138 of the first lever 131 performs a movement in the forward and upward direction. Accordingly, the location at which the first segment 21 is attached to the first lever 131 also performs a forward and upward movement as the backrest is reclined. This movement of the first segment causes the third lever 133 to pivot about the third pivot axis 143 in a forward direction. The mount structure 139 of the third lever 133 is caused to perform a movement in the forward and upward direction.

The reclining movement of the backrest causes the first segment 21 of the seat to be raised. The second lever 132 exerts a force onto the backrest support, with the magnitude of the force depending on the weight of the person sitting on the chair. Accordingly, the torque applied onto the backrest support 12 via the second lever 132 depends on the weight of the person sitting on the seat.

In order to reduce upward travel of a front and/or rear part of the seat, the second segment 22 is caused to pivot about an articulated connection 23 relative to the first segment 21. A linkage 120 effects this pivoting movement of the second segment 22 which limits upward travel of the front and/or rear edge of the seat.

An enlarged view of the linkage 120 is shown in FIG. 27. The linkage 120 includes a first link 121 and a second link 122. The second link 122 may be connected to the first lever 131 through a pivot 124 on the first lever 131. A pin may project at pivot 124 of the first lever 131 into a slot 123 of the second link 122. The first link 121 may be pivoted to the base support 11 in a pivot 125. The first link 121 may be pivotably attached to the second link 122 at a pivot 126. The pivot 126 may be arranged at an outer end of the second link 122.

When the backrest is reclined, the first lever 131 pivots. This causes the pivot 126 to travel upward when the backrest is reclined, because the slot 123 is pushed downward by the movement of the first lever 131.

The first link 121 may be fitted to a front edge of the second segment 22 at a pivot 127. When the backrest is reclined, the first link 121 pulls down the front edge of the second segment 22 relative to the first segment 21. The upward travel of the front edge of the second segment 22 is thereby reduced.

A linkage 120 configured as explained with reference to FIG. 26 and FIG. 27 may also be interconnected between the first lever 131 of the second recline mechanism 107 and the front end of the second segment 22 of the segmented member.

Operation of the tilt mechanism 10 of FIG. 25 to FIG. 30 will be explained in more detail with reference to FIG. 28 and FIG. 29. FIG. 28 shows the tilt mechanism 10 in a state when the backrest is not reclined. FIG. 29 shows the tilt mechanism 10 in a state in which the backrest is fully reclines.

The reclining motion of the backrest support 12 causes the first lever 131 and the third lever 133 to pivot, raising the first segment 21 of the seat upward. The linkage 120 pulls the front end of the second segment 22 downward to pivot the second segment 22 relative to the first segment 21 about the articulated connection 23. Upward travel of the front end of the seat may thereby be reduced, as illustrated in FIG. 30.

In any one of the tilt mechanisms explained with reference to FIG. 1 to FIG. 30 above, the linkage may not only be operative to pivot the second segment relative to the first segment when the backrest is reclined, but may also be operative to pivot the second segment back to a rest configuration relative to the first segment when the backrest is returned to the frontmost position. The linkage may pivot the second segment downward relative to the first segment when the first segment is raised. The linkage may pivot the second segment upward relative to the first segment when the first segment is lowered.

Modifications and alterations may be implemented in tilt mechanisms of further embodiments.

For illustration, the tilt mechanism may include a slider system for depth adjustment and/or a pair of recline mechanisms provided on opposite lateral sides of the seating furniture not only when the front segment of the seat is pivoted downward, but also when the rear segment of the seat is pivoted downward during backrest recline.

It will be appreciated that the tilt mechanism according to embodiments may be used in chairs and other seating furniture of various other kinds and types.

Various effects may be attained by tilt mechanisms of embodiments and seating furniture using the same. The configuration of the tilt mechanism allows weight-responsive recline characteristics to be attained while mitigating problems associated with large upward travel of the front end and/or rear end of the seat.

The invention claimed is:

1. A tilt mechanism for a weight-responsive seating furniture, the tilt mechanism comprising:

a base support;

a backrest support;

a seat panel;

a seat support coupled to the backrest support such that the seat support is displaced relative to the base support when the backrest support is pivoted;

a segmented member comprising:

a first segment which is attached to the seat support or which is integrally formed with the seat support, and a second segment which is articulated to the first segment;

wherein the segmented member is sandwiched between the seat support and the seat panel; and a linkage coupled to the second segment to pivot the second segment relative to the first segment when the seat support is displaced relative to the base support, wherein the tilt mechanism provides an adjustable seat depth.

2. The tilt mechanism of claim 1, wherein the segmented member is overlaid on the seat support.

3. The tilt mechanism of claim 1, wherein the linkage is configured to pivot the second segment downward relative to the first segment when the first segment is displaced upward by the seat support, and wherein the linkage is configured to pivot the second segment upward relative to the first segment when the first segment is displaced downward by the seat support.

4. The tilt mechanism of claim 1, wherein the linkage is pivotably coupled to the second segment and to at least one of the base support and the backrest support.

5. The tilt mechanism of claim 1, wherein the second segment is attached to a front end of the first segment.

6. The tilt mechanism of claim 1, wherein the second segment is attached to a rear end of the first segment.

7. The tilt mechanism of claim 1, wherein the segmented member further comprises:

a third segment articulated to the first segment, the third segment and the second segment being provided on opposite sides of the first segment.

8. The tilt mechanism of claim 7, further comprising:

a further linkage coupled to the third segment to pivot the third segment relative to the first segment when the seat support is displaced relative to the base support.

9. The tilt mechanism of claim 1, wherein the segmented member is a seat of the weight-responsive seating furniture.

10. The tilt mechanism of claim 1, wherein the seat panel comprises a first seat section, a second seat section and an articulated connection between the first seat section and the second seat section, wherein the articulated connection of the seat panel overlaps with a position at which the second segment is articulated to the first segment.

11. The tilt mechanism of claim 1, wherein the seat support comprises a first lever, wherein the tilt mechanism comprises a second lever pivotably attached to the backrest support and coupled to the first lever to pivot the first lever when the backrest support pivots, and wherein the linkage comprises:

a first link coupled to the second segment, and a second link coupled to the first link and the first lever.

12. The tilt mechanism of claim 11, wherein the first lever or the second link comprises a slot in which a projection of the other one of the first lever or the second link is slidably received.

13. The tilt mechanism of claim 12, wherein the second lever is pivotably coupled to the first lever, and wherein the tilt mechanism comprises an energy storage mechanism which biases at least one of the second lever and the backrest support.

14. A seating furniture, comprising:

the tilt mechanism of claim 1.

15. A tilt mechanism for a weight-responsive seating furniture, the tilt mechanism comprising:

a base support;

a backrest support;

a seat support coupled to the backrest support such that the seat support is displaced relative to the base support when the backrest support is pivoted;

a segmented member comprising:

a first segment which is attached to the seat support or which is integrally formed with the seat support, and a second segment which is articulated to the first segment; and a linkage coupled to the second segment to pivot the second segment relative to the first segment when the seat support is displaced relative to the base support, wherein the seat support comprises a first lever, wherein the tilt mechanism comprises a second lever pivotably attached to the backrest support and coupled to the first lever to pivot the first lever when the backrest support pivots, and wherein the linkage comprises:

a first link coupled to the second segment, and a second link coupled to the first link and to the first lever, and wherein the first lever or the second link comprises a slot in which a projection of the other one of the first lever or the second link is slidably received.

16. The tilt mechanism of claim 15, wherein the second lever is pivotably coupled to the first lever, and wherein the tilt mechanism comprises an energy storage mechanism which biases at least one of the second lever and the backrest support.

17. A seating furniture, comprising:

the tilt mechanism of claim 15.

18. The tilt mechanism of claim 15, wherein the segmented member is overlaid on the seat support.

19. The tilt mechanism of claim 15, wherein the linkage is configured to pivot the second segment downward relative to the first segment when the first segment is displaced upward by the seat support, and wherein the linkage is configured to pivot the second segment upward relative to the first segment when the first segment is displaced downward by the seat support.

20. The tilt mechanism of claim 15, wherein the linkage is pivotably coupled to the second segment and to at least one of the base support and the backrest support.

* * * * *